US011135494B2

(12) United States Patent
Heppner

(10) Patent No.: US 11,135,494 B2
(45) Date of Patent: Oct. 5, 2021

(54) TRAINING AID SUPPORT BASE AND ASSEMBLY

(71) Applicant: D.N.J. Athletics LLC, Lake Orion, MI (US)

(72) Inventor: Joshua Heppner, Lake Orion, MI (US)

( * ) Notice: Subject to any disclaimer, the term of this patent is extended or adjusted under 35 U.S.C. 154(b) by 0 days.

(21) Appl. No.: 16/937,778

(22) Filed: Jul. 24, 2020

(65) Prior Publication Data

US 2021/0023432 A1 Jan. 28, 2021

Related U.S. Application Data

(60) Provisional application No. 62/878,838, filed on Jul. 26, 2019, provisional application No. 62/887,873, filed on Aug. 16, 2019.

(51) Int. Cl.
*A63B 69/34* (2006.01)
*A63B 71/00* (2006.01)

(52) U.S. Cl.
CPC ..... *A63B 69/345* (2013.01); *A63B 71/0054* (2013.01); *A63B 2071/0063* (2013.01); *A63B 2243/007* (2013.01)

(58) Field of Classification Search
CPC ..... A63B 69/345; A63B 2071/0063; A63B 71/0054; A63B 2243/007; A63B 2210/50; A63B 71/023; A63B 2214/00
USPC ..... 473/441, 442, 444, 445
See application file for complete search history.

(56) References Cited

U.S. PATENT DOCUMENTS

| | | | | |
|---|---|---|---|---|
| 2,167,198 | A * | 7/1939 | Brownstein | A47F 7/30 211/28 |
| 2,253,764 | A * | 8/1941 | Condon | A47F 7/30 211/28 |
| 3,902,721 | A * | 9/1975 | Piccini | F41J 3/0004 273/404 |
| 5,685,440 | A * | 11/1997 | Mason | A47F 5/13 211/189 |
| 7,328,902 | B1 * | 2/2008 | White | A63B 63/00 273/343 |
| 7,794,337 | B2 * | 9/2010 | Gamboa | A63B 69/345 473/441 |
| D659,779 | S * | 5/2012 | Gray | D21/698 |
| 2008/0312009 | A1 * | 12/2008 | Gilman | A63B 21/4001 473/445 |
| 2015/0231475 | A1 * | 8/2015 | Tompkins | A63B 69/345 473/445 |

* cited by examiner

*Primary Examiner* — Nini F Legesse
(74) *Attorney, Agent, or Firm* — Fitch, Even, Tabin & Flannery LLP

(57) ABSTRACT

A support base for a training aid assembly includes opposing longitudinal support bars and first and second raised lips that extend between the opposing longitudinal support bars at a opposing end portions of the support base. An intermediate raised member extends between the opposing longitudinal support bars at an intermediate portion of the support base between the opposing end portions.

20 Claims, 21 Drawing Sheets

TRAINING AID SUPPORT BASE AND ASSEMBLY

RELATED APPLICATIONS

This application claims the benefit of U.S. Provisional Application No. 62/878,838, filed Jul. 26, 2019, entitled "Training Aid Support Base And Assembly," and U.S. Provisional Application No. 62/887,873, filed Aug. 16, 2019, entitled "Training Aid Support Base And Assembly," both of which are hereby incorporated by reference in their entireties herein.

FIELD

The present disclosure generally relates to a training aid support base and assembly, and more particularly, to a support base for supporting a training pad in an upright position.

BACKGROUND

Many athletic associations and organizations have changed rules and requirements in an effort to increase safety among players. Such rule changes include setting or reducing restrictions on the amount of time over a given period that players are permitted to participate in so-called "live" or full-contact practices. For example, some athletic associations have limited member football programs to no more than six hours of full-pads collision contact per week during of preseason practice, and no more than 30 minutes of collision contact during a week of in-season practice. The term "collision" may be defined as "contact at game speed, with the execution of full tackles at a competitive pace, taking players to the ground."

During non-collision practices, or non-collision portions of practices, coaches seek to maintain the instruction, pace, and repetition often exhibited during collision contact practices. In many instances, however, such practices may not be as efficient as collision contact practices. For example, repetitions may be limited to a certain number of participants at a given time, requiring other players to wait for their turn. In another example, during a repetition, non-participating players may be asked to hold a pad or bag, or otherwise simulate an opposing player. In these examples, optimal instruction is often limited to the participating players.

In some instances, coaches utilize standalone equipment in place of one or more human players. For example, cones, garbage bins, etc., are often used to simulate one or more opposing players. However, such equipment is often insufficient to simulate in-game situations and, in some occasions, can pose safety risks.

Other standalone equipment may include dedicated training aids such as tackling dummies, tackling rings, sleds, etc. Such equipment is often expensive and, in some cases, cost prohibitive. Furthermore, such equipment is often drill-specific, requiring the purchase of various types of training aids for multiple given drills. Still further, such equipment is often cumbersome and bulky, and requires corresponding storage space.

DETAILED DESCRIPTION

Embodiments of the present disclosure are described herein. It is to be understood, however, that the disclosed embodiments are merely examples and other embodiments may take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the present invention. As those of ordinary skill in the art will understand, various features illustrated and described with reference to any one of the figures may be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Disclosed herein is a support base or stand for use with a training pad that coaches may use for various forms of simulation and instruction during football practices. The support base is dimensioned such that the width and length encourage players to finish drills or tasks with a preferred stance or form. Furthermore, the distance between the middle and back supports creates the appropriate space for a training pad to slide in, while also positioning the training pad at approximately a 30 degree angle. Such an angle encourages players to sink their hips in the appropriate way to perform proper hitting or blocking techniques. Use of the training aid assemblies described herein may allow for greater practice efficiency (e.g., increased repetitions, increased pace of play, etc.) while reducing player collisions in a given practice. The support base is a portable, light weight, durable stand that may be quickly and easily moved or repositioned. Furthermore, the support base is dimensioned such that it is nestable or stackable to facilitate storage of multiple support bases.

Figure 1:
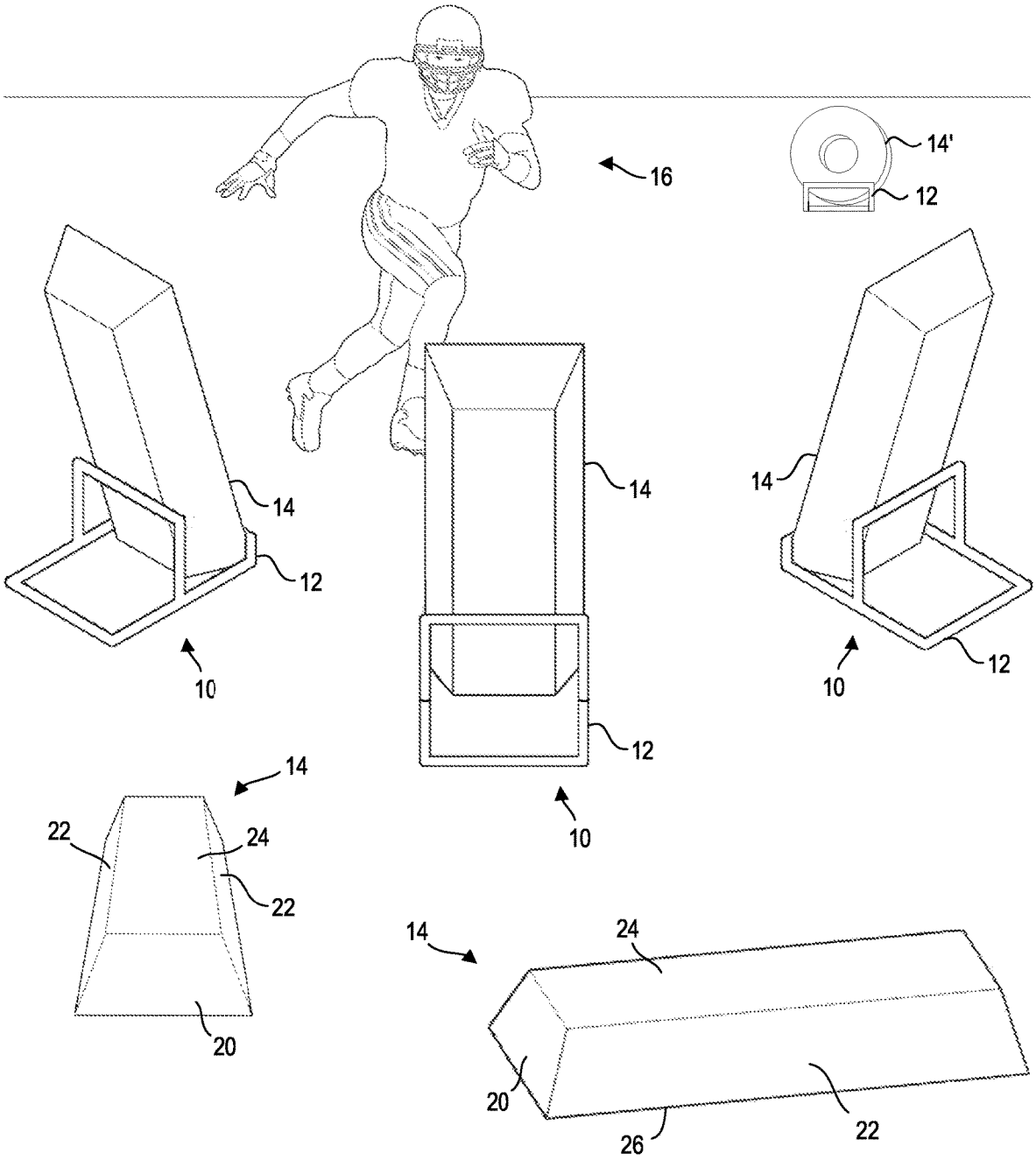
FIG. 1 is perspective view showing a training aid assembly as it may be used during an athletic practice.
Figure 2:
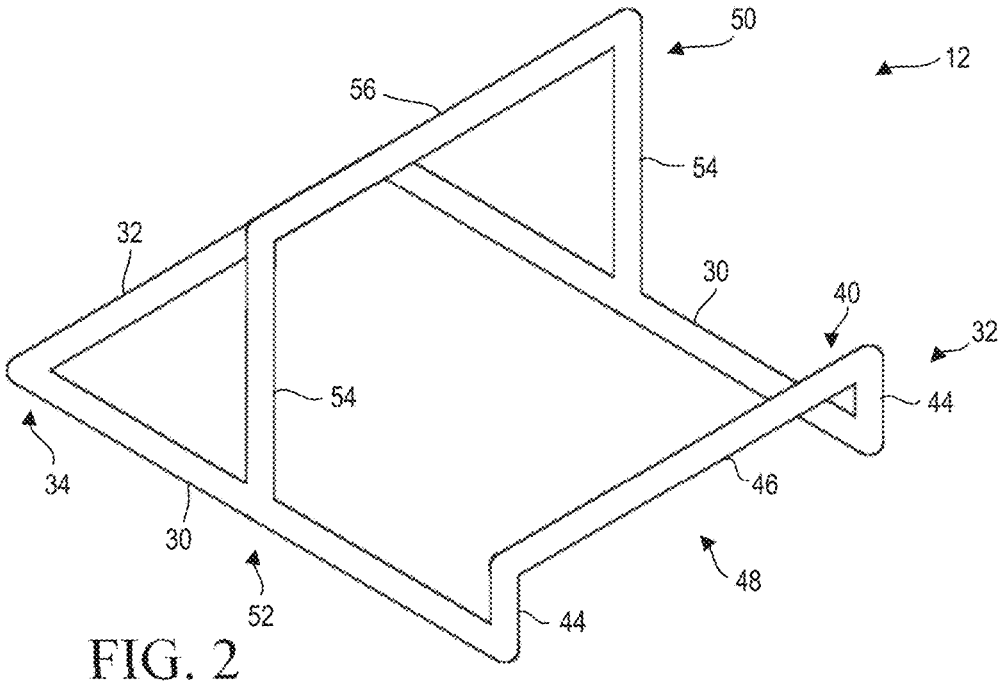
FIG. 2 is a rear perspective view of a support base for the training aid assembly of FIG. 1.
Figure 3:
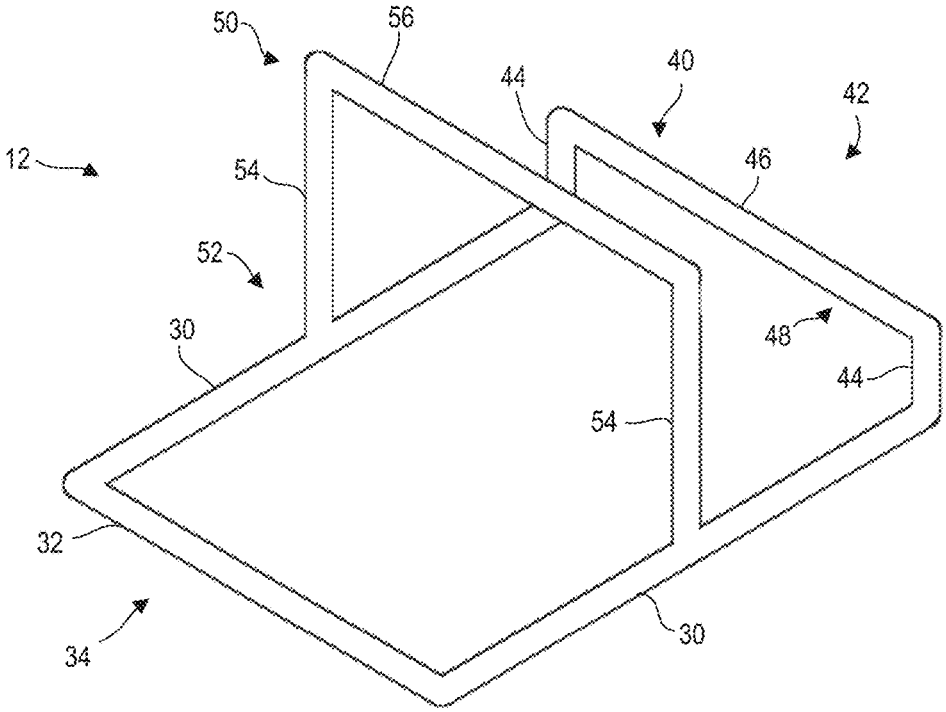
FIG. 3 is a front perspective view of the support base.
Figure 4:
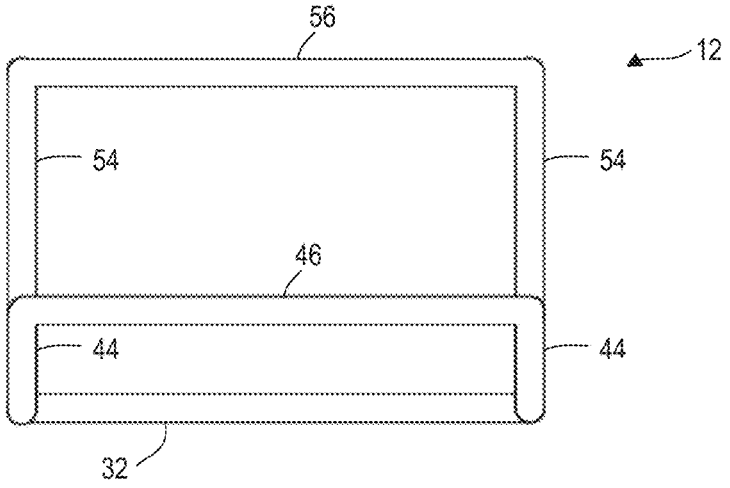
FIG. 4 is a rear elevation view of the support base.
Figure 5:
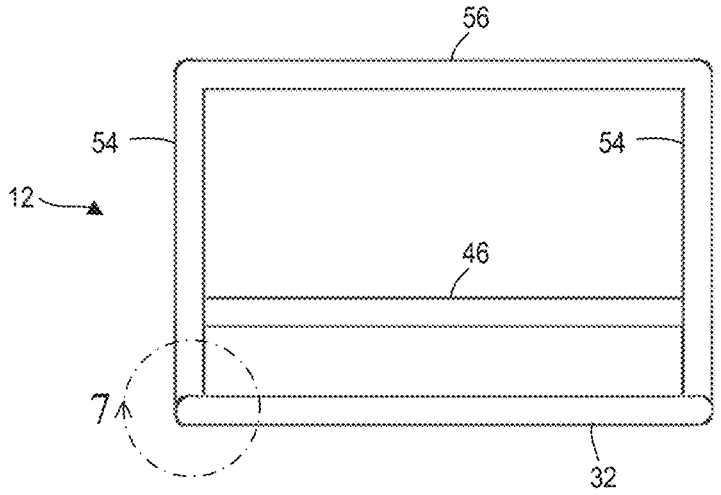
FIG. 5 is a front elevation view of the support base.
Figure 6:
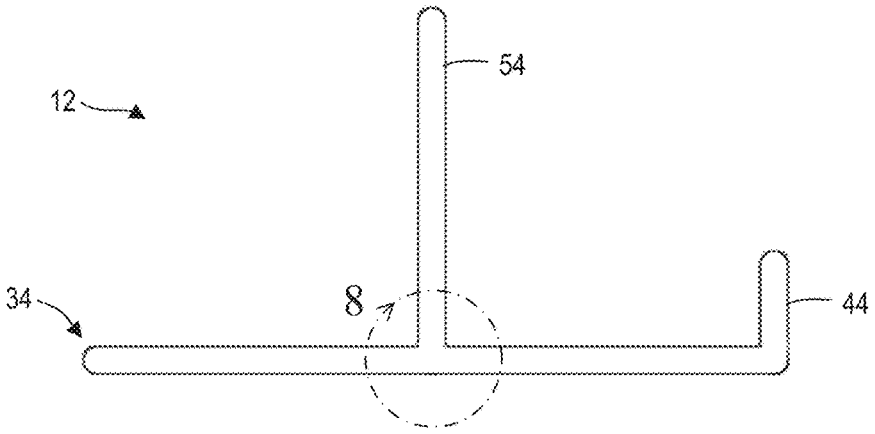
FIG. 6 is a right side elevation view of the support base, the left side elevation view being a mirror image of the right side elevation view.

Referring now to FIG. 1, training aid assemblies 10 described herein may be used during athletic training. A training aid assembly 10 includes a support base 12 that supports a training pad 14. FIG. 1 shows three assembled training aid assemblies 10 and two additional training pads 14 in use during a football practice. Each support base 12 of the assembled training aid assemblies 10 supports a training pad 14 in a generally upright position, which may be a tilted upright position or a fully vertical upright position. In this way, each training aid assembly 10 may simulate an opposing player, and multiple training aid assemblies may be arranged to simulate multiple opposing players. As used herein, the term "upright" may refer to the direction of a long axis of the training pad, and "generally upright position" may refer to an orientation of the long axis that is closer to vertical than horizontal (e.g., in the range of approximately 0 degrees to less than approximately 45 degrees off vertical). For example, in FIG. 1, the three assembled training aid assemblies 10 show respective training pads 14 in generally upright positions, and the two additional training pads 14 are shown in horizontal positions.

The training pad 14 may be, for example, shaped as a cuboid such as a quadrilateral or rectangular frustum. In the approach shown in FIG. 1, the training pad 14 is an elongated training pad 14, which may be referred to as an "agility" pad, that has opposing end faces 20, and elongated side faces 22, a top face 24, and a bottom face 26 that extend between the end faces 20. Other shapes are expressly contemplated. For example, a training pad may be a generally cylindrical training pad (e.g., a "dummy"), a cylindrical segment training pad (e.g., a "half round"), or a generally rectangular training pad (e.g., a "shield"). In still another example, the training pad may be a generally circular or ring-shaped "tackle wheel" or "tackling ring" 14'. A tackle wheel 14' may have an outer diameter, for example, of approximately, 28 inches, 36 inches, 42 inches, 48 inches, 52 inches, 60 inches, or other suitable dimension. A training pad 14 may have a rigidity sufficient to maintain the training pad 14 in an upright position (e.g., in an upright elongated configuration when propped on an end face 20 in the support base 12), while still being sufficiently deformable such that it may absorb an impact from a training athlete 16. In one approach, the training pad 14 may be a pad assembly that includes a foam core (e.g., a rebond foam core) and a cover (e.g., a coated vinyl cover) that is disposed about the foam core.

Referring to FIGS. 2-10, a support base 12 includes opposing longitudinal side bars 30. A cross bar 32 extends orthogonally between the side bars 30 at a distal portion, end, or region 34 of the support base 12. In one aspect, the cross bar 32 is generally coplanar with the side bars 30. A lip 40 extends between the side bars 30 at a proximal portion, end, or region 42 of the support base 12. In one approach, the lip 40 includes upright lip arms 44 that extend upwardly and orthogonally from the side bars 30, and a front support bar 46 that extends orthogonally between the lip arms 44. The lip arms 44 and front support bar 46 cooperate to define a pad receiving region 48.

The support base 12 further includes a middle support 50 disposed at a mid-region 52 between the distal region 34 and the proximal region 42. In one approach, the middle support 50 includes upright support arms 54 that extend upwardly and orthogonally from the side bars 30, and a middle support bar 56 that extends orthogonally between the support arms 54. As shown, for example, in FIGS. 4 and 6, the support arms 54 extend a greater distance from the side bars 30 than the lip arms 44.

Figure 7:
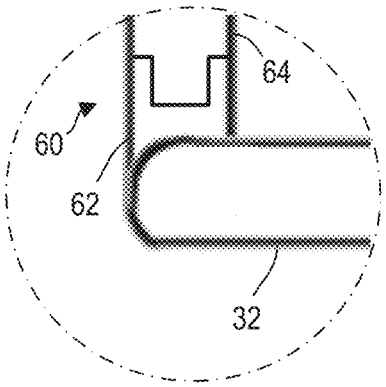
FIG. 7 is an enlarged view of a portion of FIG. 5 showing an optional hinge arrangement from the front elevation view of the support base.
Figure 8:
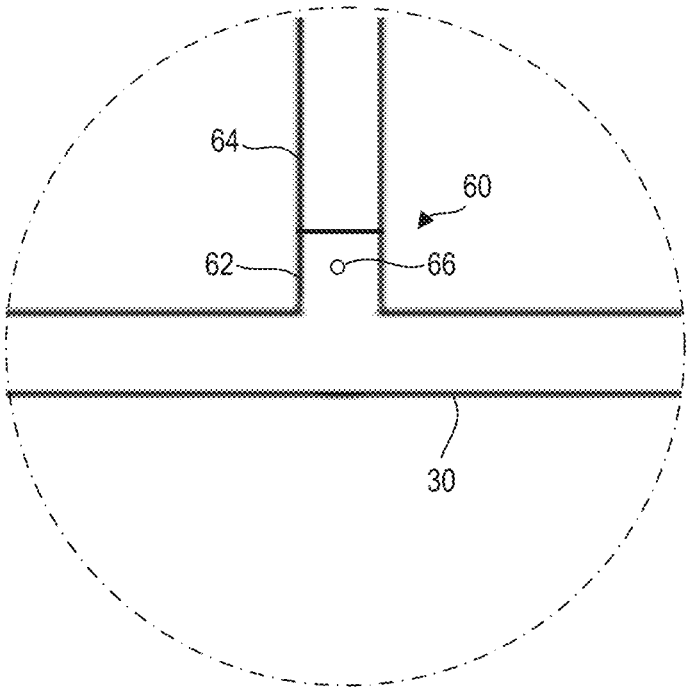
FIG. 8 is an enlarged view of a portion of FIG. 6 showing the optional hinge arrangement from the right side elevation view of the support base.
Figure 9:
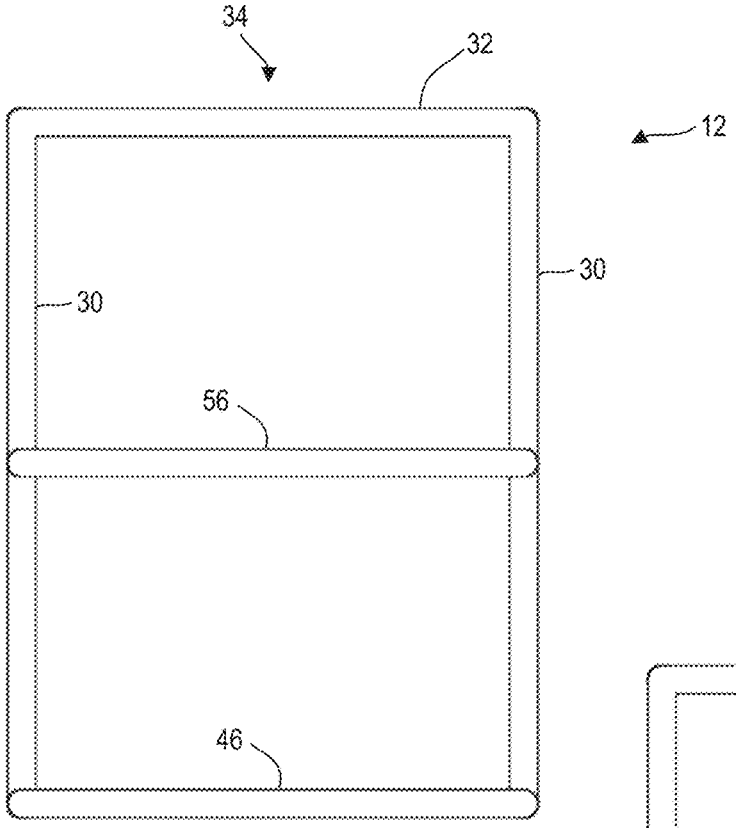
FIG. 9 is a top plan view of the support base.
Figure 10:
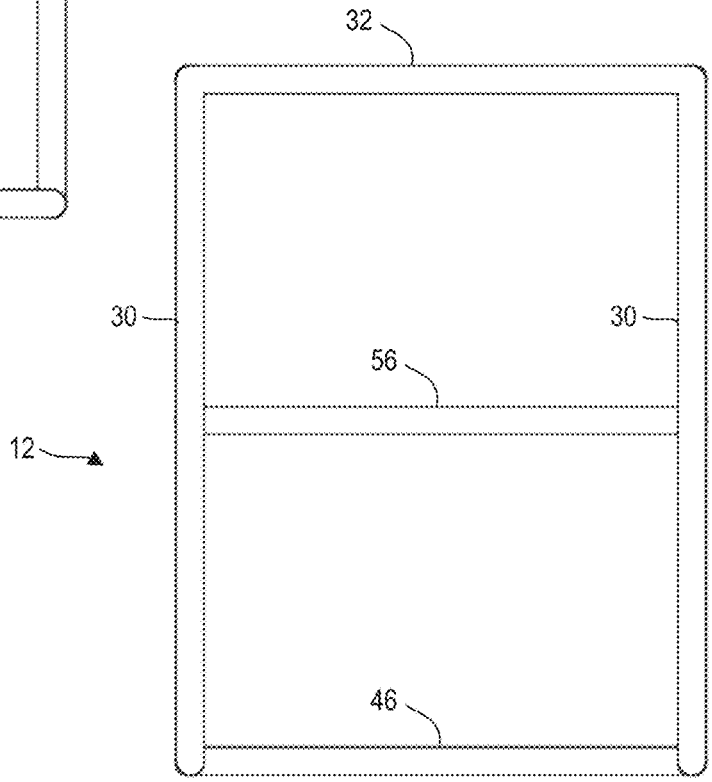
FIG. 10 is a bottom plan view of the support base.
Figure 11:
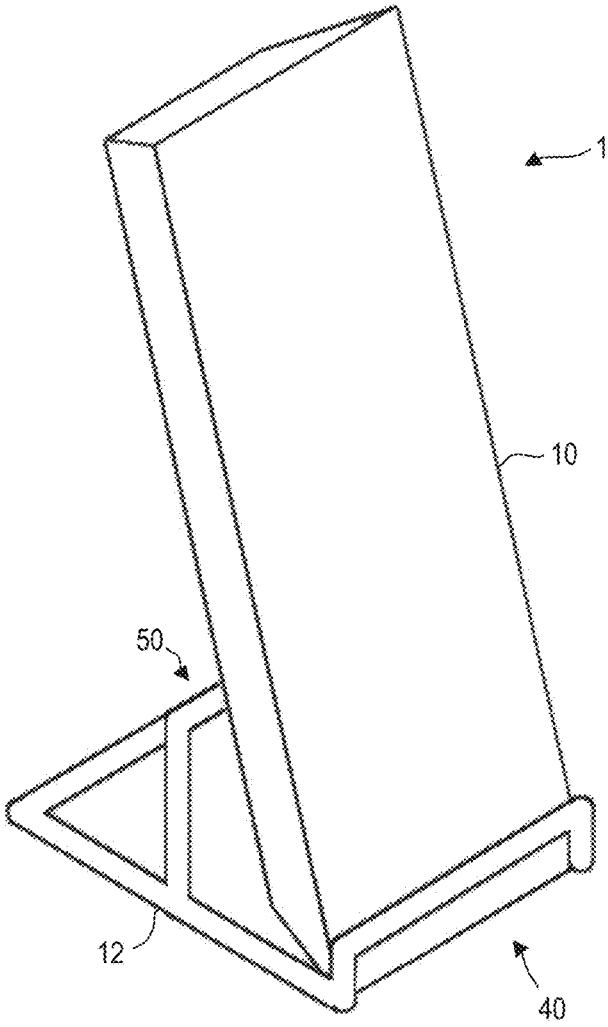
FIG. 11 is a rear perspective view of the training aid assembly including a training aid disposed on the support base.
Figure 12:
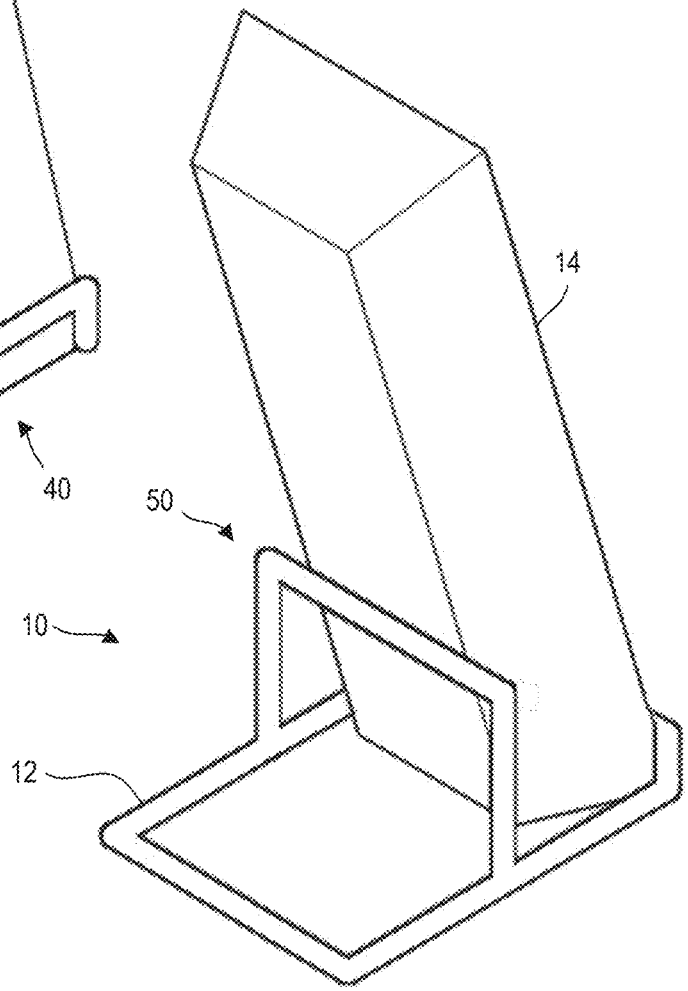
FIG. 12 is a front perspective view of the training aid assembly.
Figure 13:
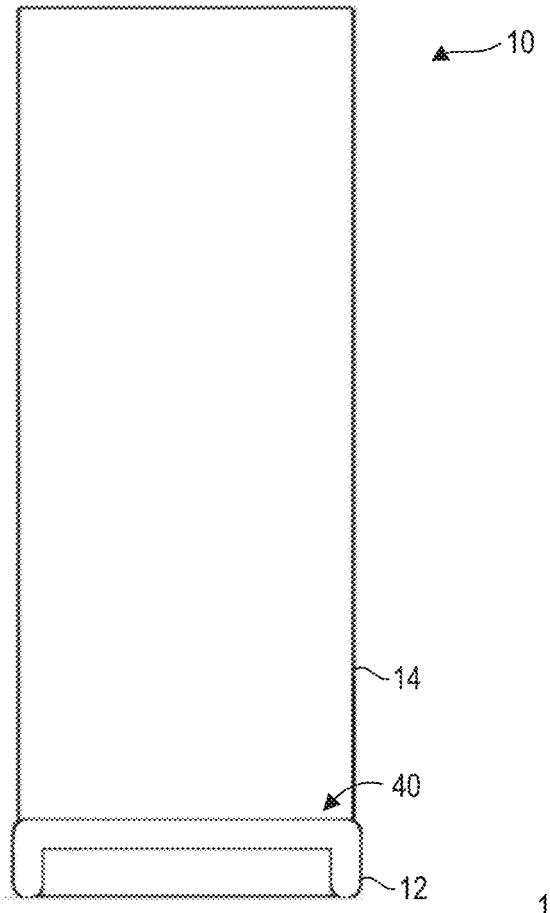
FIG. 13 is a rear elevation view of the training aid assembly.
Figure 14:
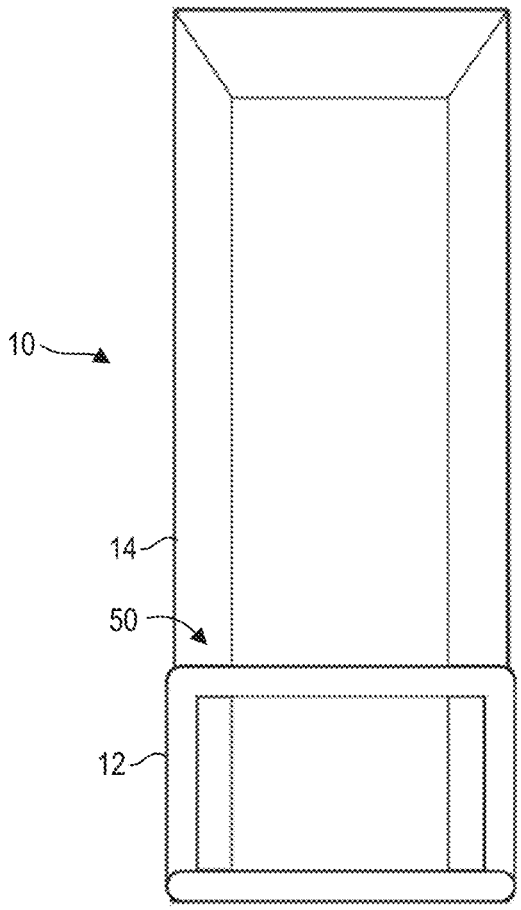
FIG. 14 is a front elevation view of the training aid assembly.
Figure 15:
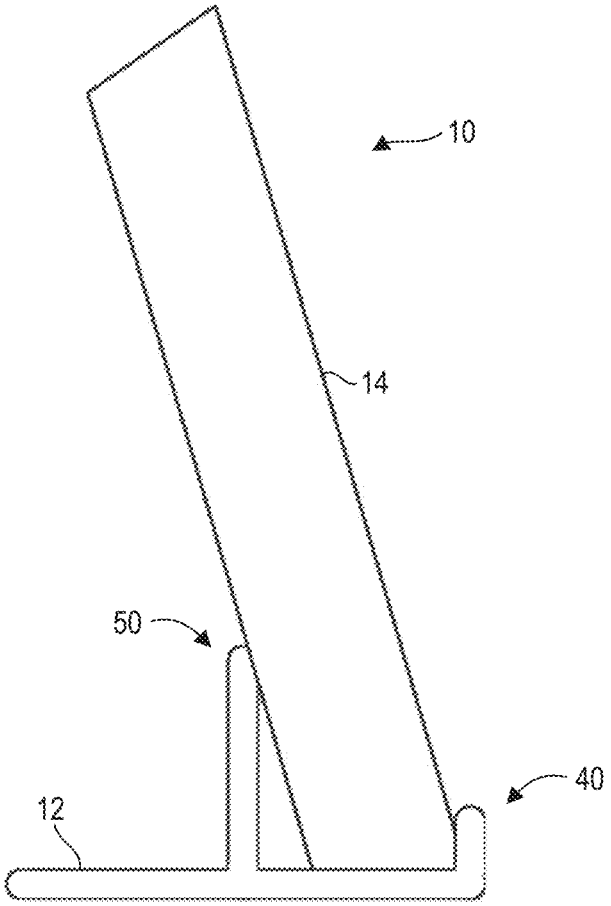
FIG. 15 is a right side elevation view of the training aid assembly, the left side elevation view being a mirror image of the right side elevation view.
Figure 16:
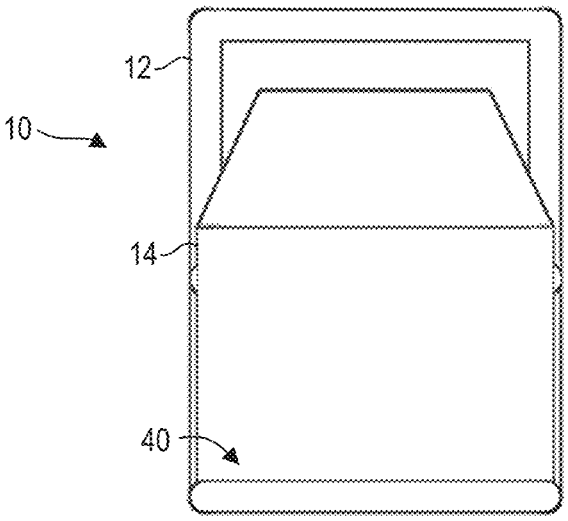
FIG. 16 is a top plan view of the training aid assembly.

Referring to FIGS. 7 and 8, in one approach, the middle support 50 may include a hinge 60 proximate the interface with side bars 30. In one example, an upright support arm 54 of the middle support 50 may include a fixed lower portion 62, and a pivotable upper portion 64 that is hingedly connected to the fixed lower portion 62 via a hinge pin 66. In this way, the middle support 50 may be pivotable between an upright position and a lowered position. Pivoting the middle support 50 to the lowered position may facilitate stacking and/or general storage of the support base 12.

Referring to FIGS. 11-16, in the assembled configuration of the training aid assembly 10, the support base 12 supports a training pad 14 in a generally upright position. More particularly, the training pad 14 is positioned such that an end portion of the training pad 14 engages the lip 40 of the support base 12, and a mid-portion of the training pad 14 engages the middle support 50 of the support base 12. The lip 40 and the middle support 50 cooperate to maintain the training pad in the generally upright position.

In use, a person may impact the training pad 14 to dislodge the training pad 14 from the support base 12. For example, a training athlete 16 may tackle or otherwise hit the training pad 14, with the training pad 14 simulating an opposing player. The arrangement of the lip 40 and the middle support 50 is such that the impact quickly dislodges the training pad 14 from the support base 12. The transverse bars (e.g., cross bar 32, front support bar 46, and middle support bar 56) may have lengths that encourage the athlete 16 to maintain a wide base as the athlete 16 moves over the support base 12.

Figure 17:
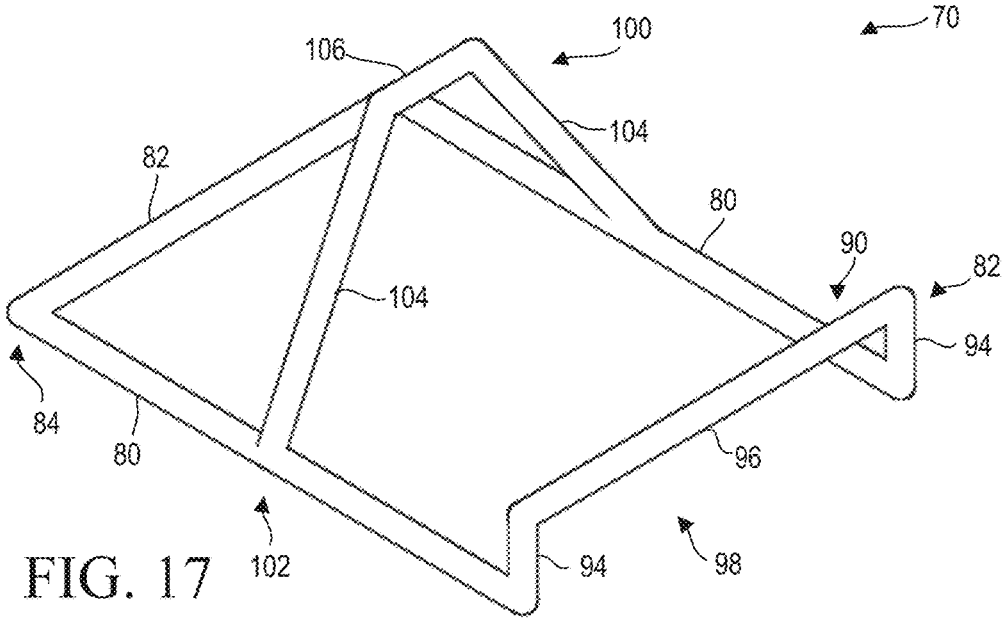
FIG. 17 is a rear perspective view of a second embodiment of a support base for the training aid assembly of FIG. 1.
Figure 18:
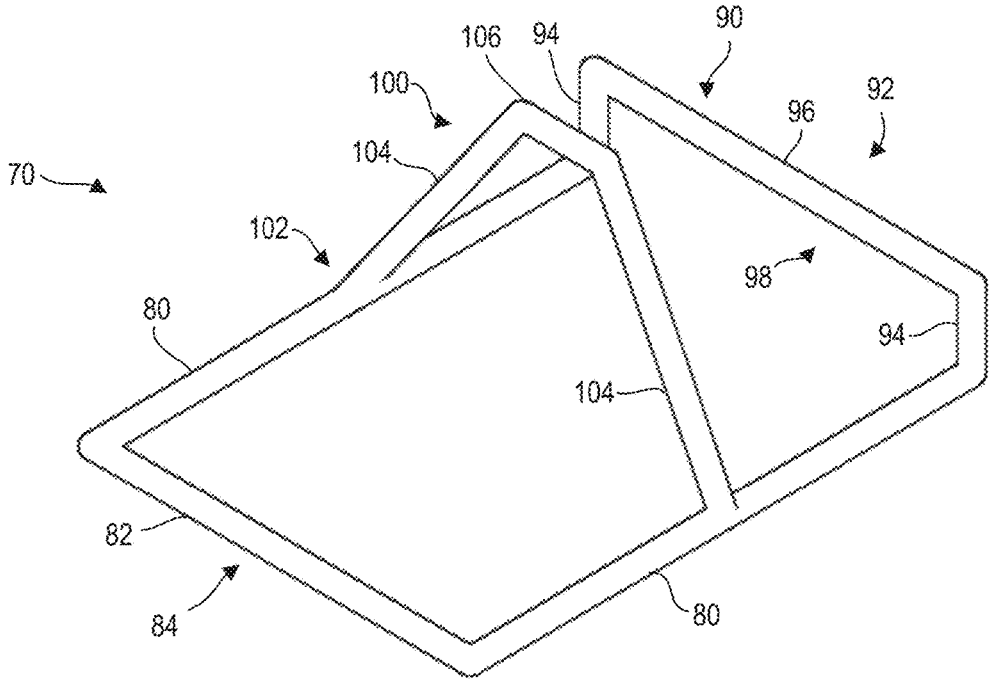
FIG. 18 is a front perspective view of the support base of FIG. 17.
Figure 19:
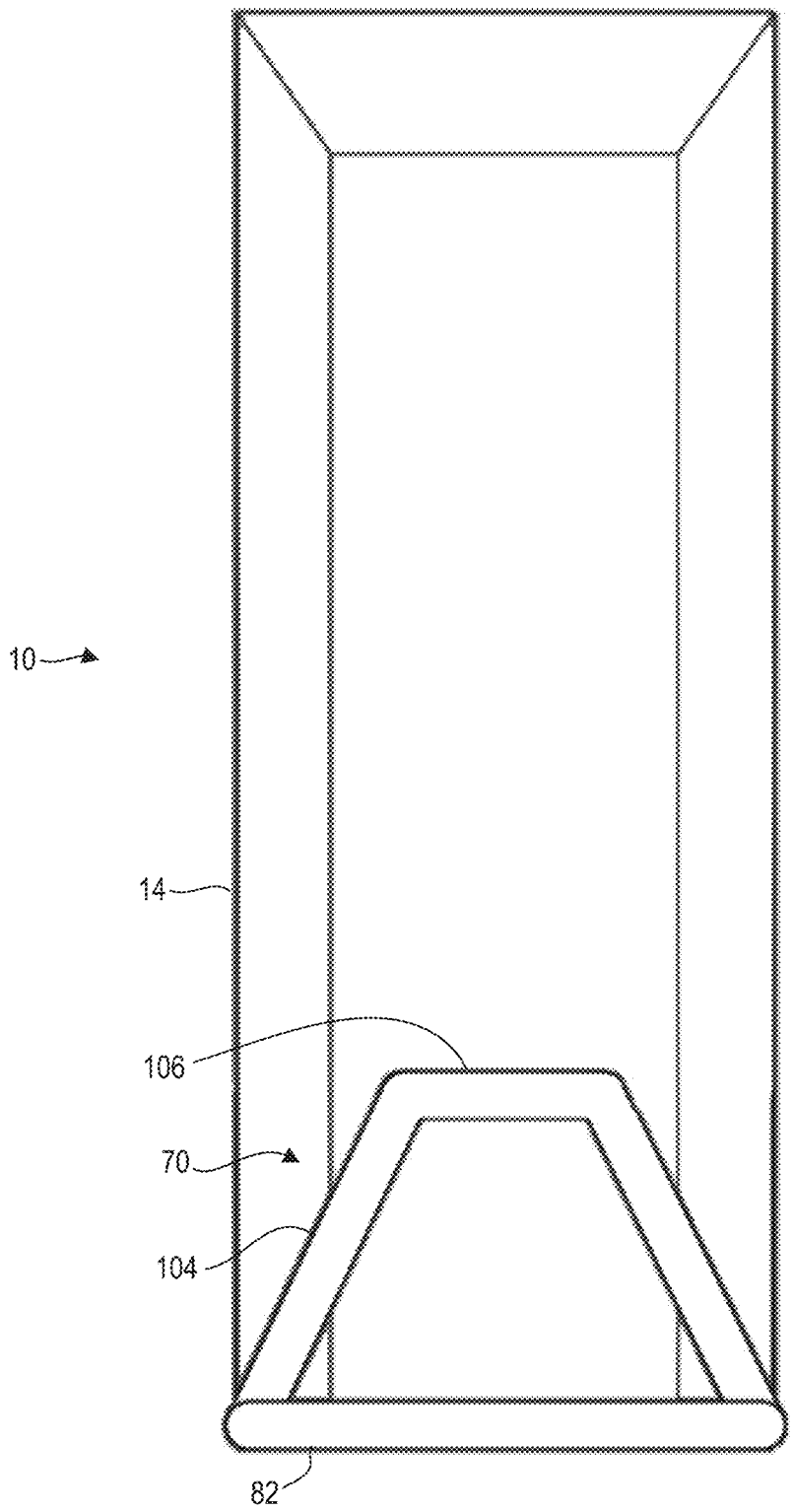
FIG. 19 is a front elevation view of the training aid assembly including a training aid disposed on the support base of FIG. 17.
Figure 20:
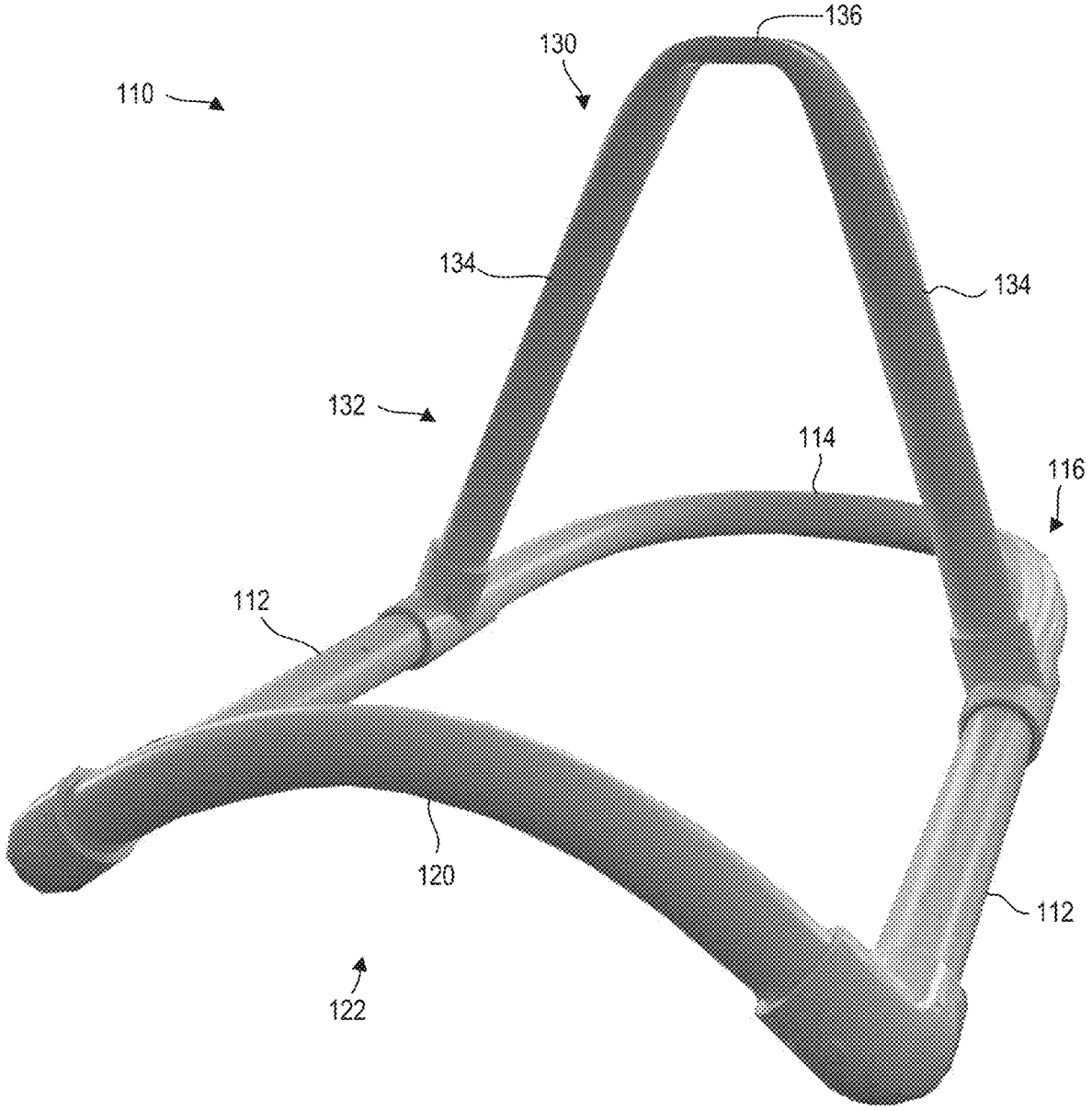
FIG. 20 is a rear perspective view of a third embodiment of a support base for the training aid assembly of FIG. 1.
Figure 21:
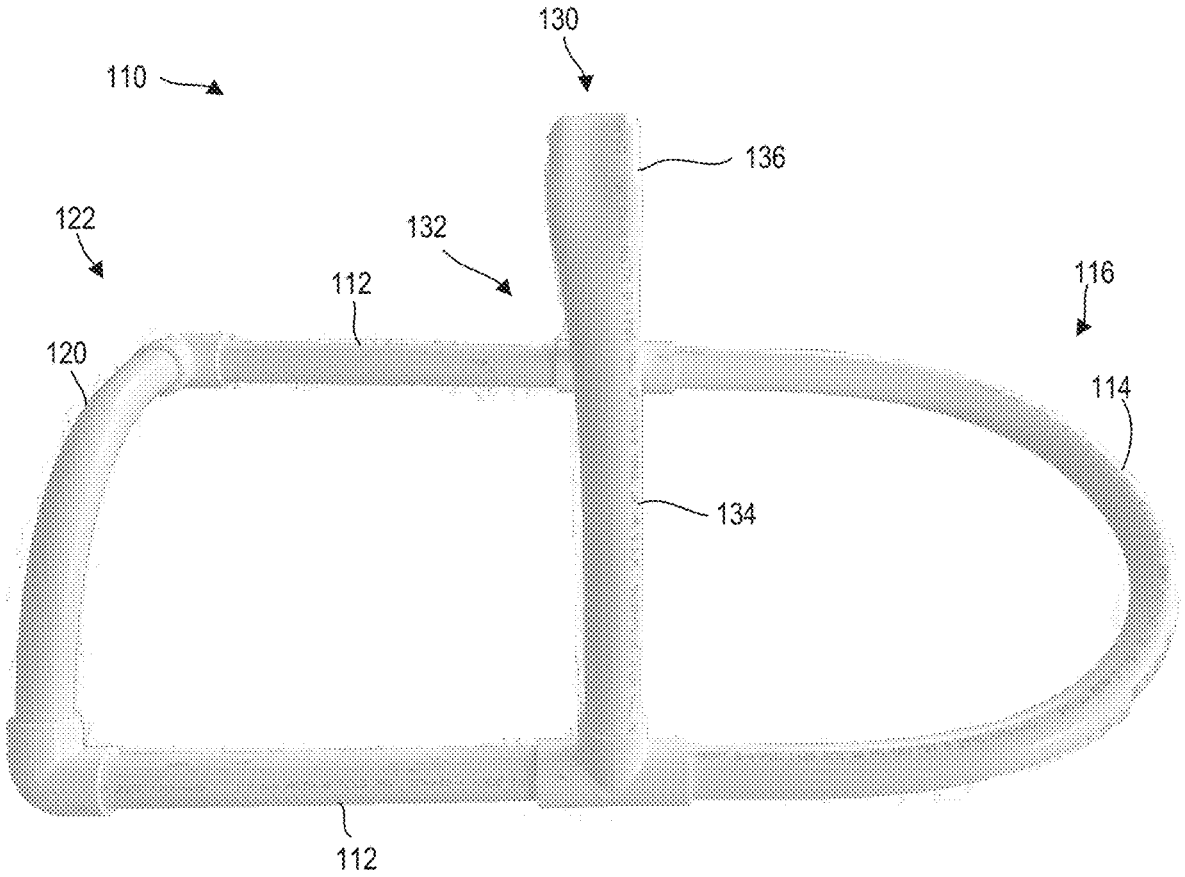
FIG. 21 is a side perspective view of the support base of FIG. 20.
Figure 22:
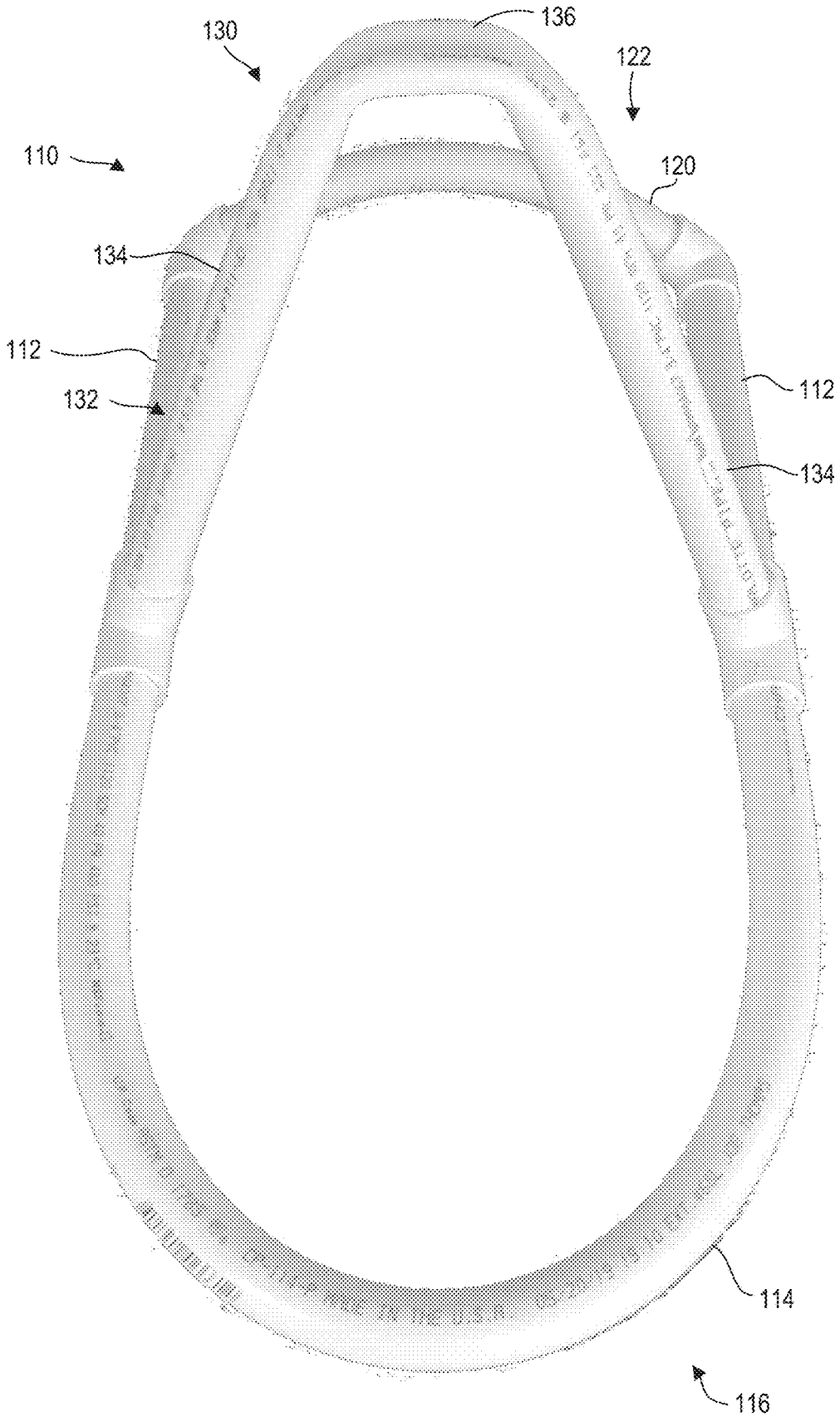
FIG. 22 is a front perspective view of the support base of FIG. 20.
Figure 23:
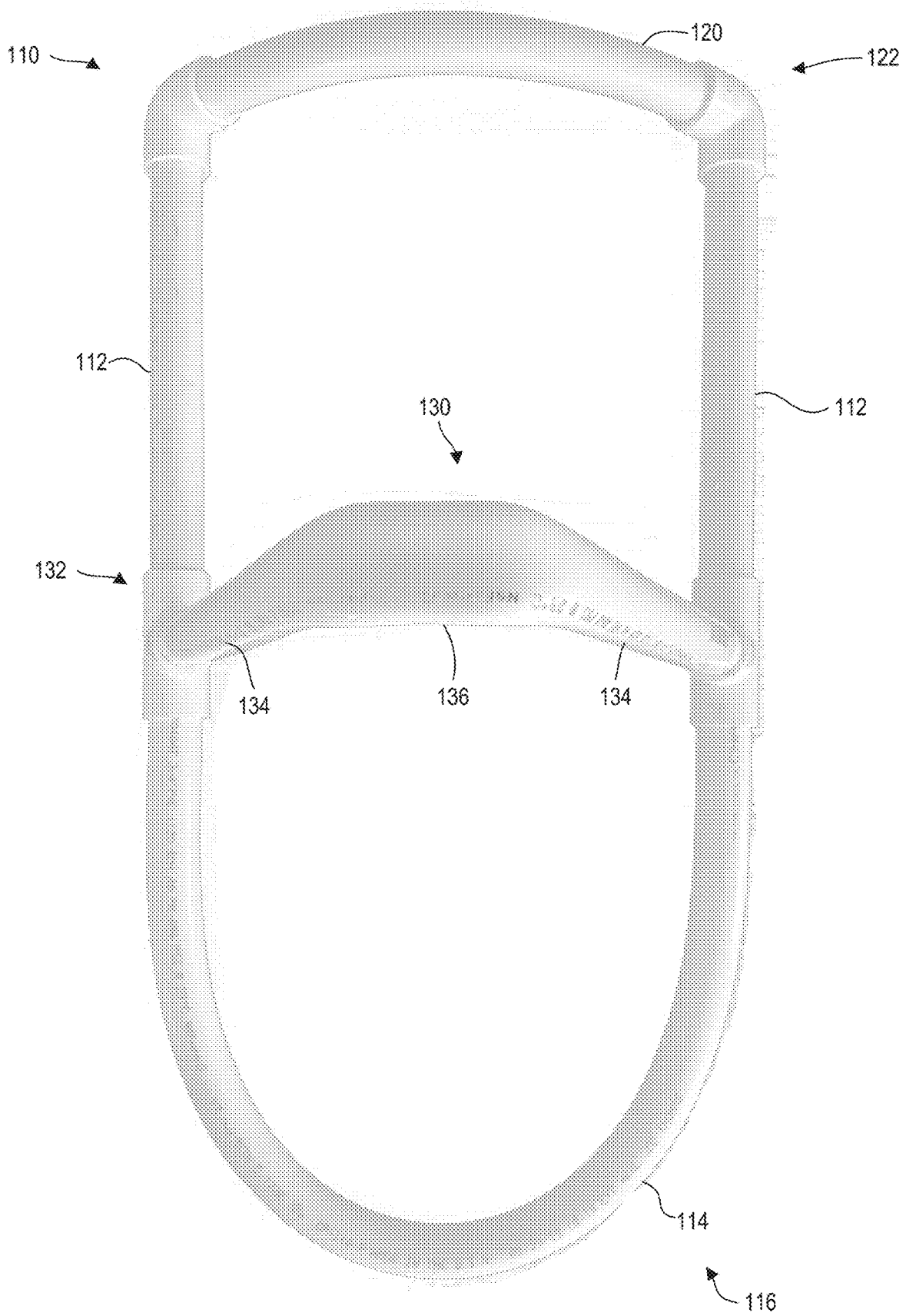
FIG. 23 is a top plan view of the support base of FIG. 20.

Referring to FIGS. 17-19, another support base 70 is shown. The support base 70 may be used in place of support base 12 in the training aid assembly 10 of FIGS. 1-16. The support base 70 includes opposing longitudinal side bars 80. A cross bar 82 extends orthogonally between the side bars 80 at a distal region 84 of the support base 70. In one aspect, the cross bar 82 is generally coplanar with the side bars 80. A lip 90 extends between the side bars 80 at a proximal region 92 of the support base 70. In one approach, the lip 90 includes upright lip arms 94 that extend upwardly and orthogonally from the side bars 80, and a front support bar 96 that extends orthogonally between the lip arms 94. The lip arms 94 and front support bar 96 cooperate to define a pad receiving region 98.

The support base 70 further includes a middle support 100 disposed at a mid-region 102 between the distal region 84 and the proximal region 92. In one approach, the middle support 100 includes upright support arms 104 that extend upwardly and inwardly from the side bars 80, and a middle support bar 106 that extends between the support arms 104.

As shown in FIG. 19, in the assembled configuration of the training aid assembly 10, the support base 70 supports a training pad 14 in a generally upright position. More particularly, the training pad 14 is positioned such that a mid-portion of the training pad 14 engages the middle support 100 of the support base 70. The lip 90 and the middle support 100 cooperate to maintain the training pad in the generally upright position.

Referring to FIGS. 20-23, another support base 110 is shown. The support base 110 may be used in place of support base 12 in the training aid assembly 10 of FIGS. 1-16. The support base 110 includes opposing longitudinal side bars 112. A stabilizer bar 114 extends between the side bars 112 at a distal region 116 of the support base 110. In one aspect, the stabilizer bar 114 is generally coplanar with the side bars 112. The stabilizer bar 114 may be a curved stabilizer bar.

A lip 120 extends between the side bars 112 at a proximal region 122 of the support base 110. In one approach, the lip 120 is a curved lip. The lip arms 94 and front support bar 96 cooperate to define a pad receiving region 98.

The support base 110 further includes a middle support 130 disposed at a mid-region (e.g., middle support 132) between the distal region 116 and the proximal region 122. In one approach, the middle support 132 includes upright support arms 134 that extend upwardly and inwardly from the side bars 112, and a middle support bar 136 that extends between the support arms 134.

In the assembled configuration of the training aid assembly 10, the support base 110 supports a training pad 14 in a generally upright position. More particularly, the training pad 14 is positioned such that a mid-portion of the training pad 14 engages the middle support 130 of the support base 110. The lip 120 and the middle support 130 cooperate to maintain the training pad in the generally upright position.

In one aspect, the lips discussed herein may taper inwardly; for example, within a plane defined by the side bars. The lips may form a generally narrowed (e.g., pointed) proximal region. Such a narrowed proximal region may facilitate storage of the support base.

In some aspects, the sides of the middle supports described herein may taper inwardly (e.g., at a generally 45 degree angle). Such a narrowed middle support may facilitate storage of the support base.

In one approach, the middle supports may be resilient middle supports configured to flex from a support position (e.g., a generally upright position shown in the Figures) to a flexed position that is offset from the support position. In one aspect, the resilient middle supports may include a spring such that the middle supports are spring-loaded middle supports. In another aspect, the middle supports may include living hinges to permit the middle supports to flex between the support position and the flexed position.

Figure 24:
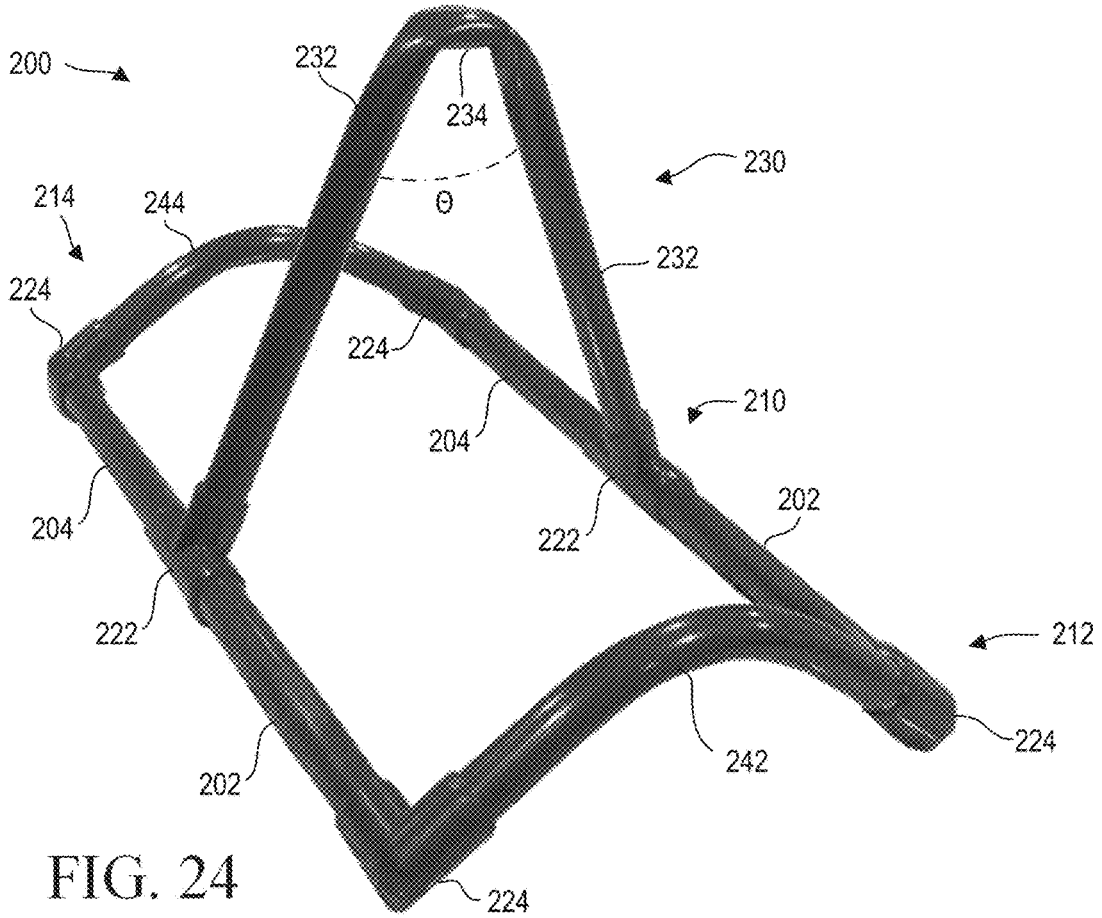
FIG. 24 is a perspective view of a fourth embodiment of a support base for the training aid assembly of FIG. 1.
Figure 25:
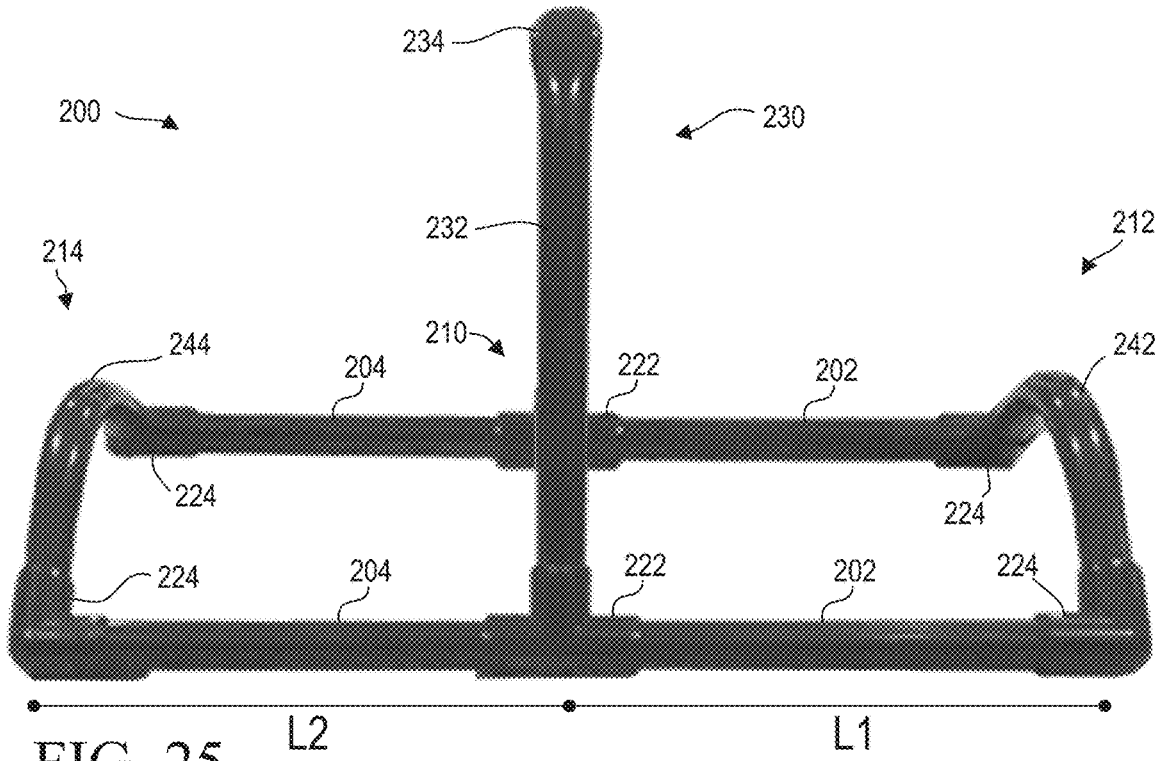
FIG. 25 is a side perspective view of the support base of FIG. 24.
Figure 26:
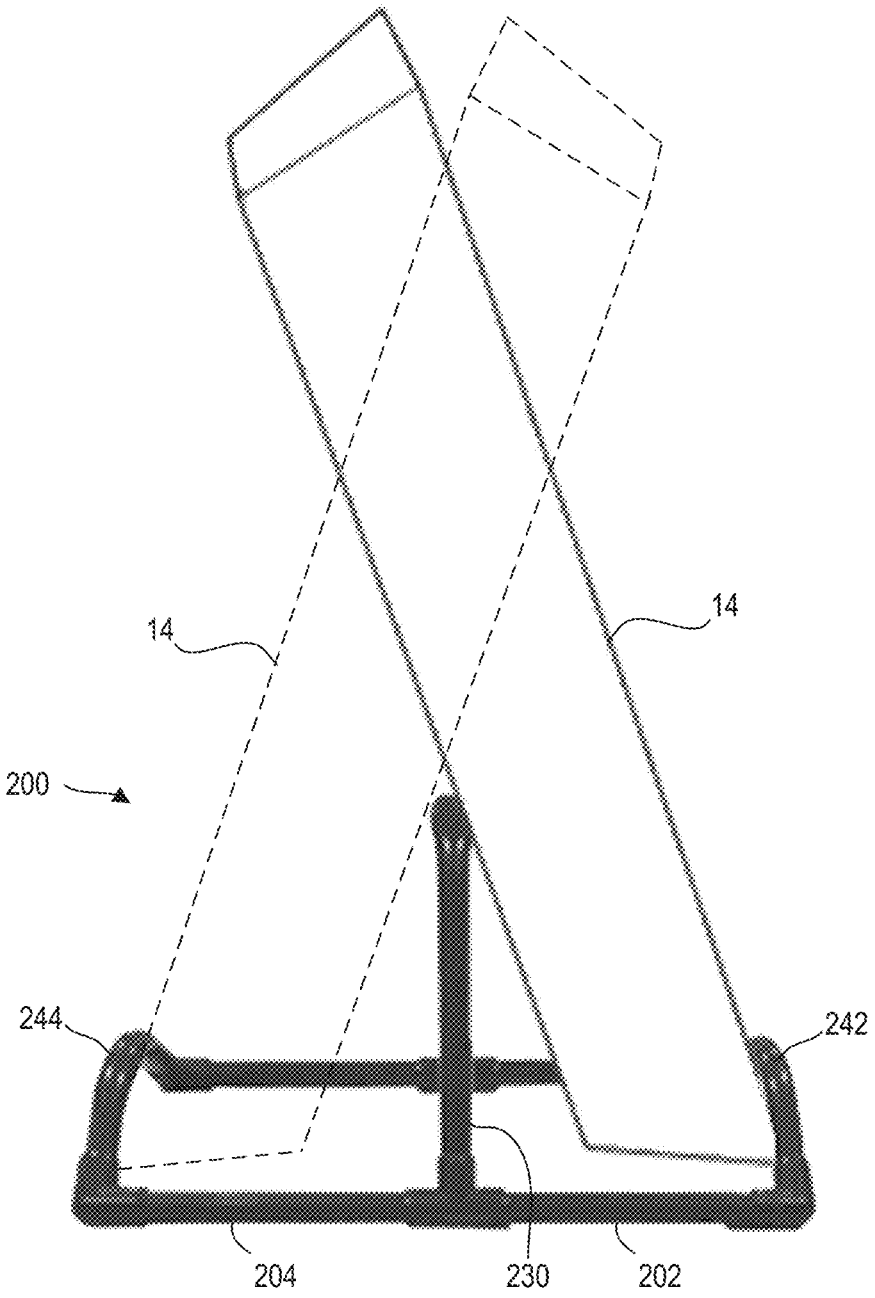
FIG. 26 is a side perspective view of the training aid assembly including a training aid disposed on the support base of FIG. 24.

Referring to FIGS. 24-26, another support base 200 is shown. The support base 200 may be used in place of support base 12 in the training aid assembly 10 of FIGS. 1-16. The support base 200 includes opposing longitudinal base or support members or side bars that extend between opposing end regions. More particularly, a first set of longitudinal base or support members or side bars 202 may extend between a central region 210 of the support base 200 and a first end portion 212 of the support base 200, and a second set of longitudinal base or support members or side bars 204 may extend between the central region 210 and a second end portion 214 of the support base 200. In at least one approach, the first set of longitudinal side bars 202 are parallel, or substantially parallel, to each other. Furthermore, the second set of longitudinal side bars 204 are parallel, or substantially parallel, to each other. The first set of longitudinal side bars 202 and the second set of longitudinal side bars 204 may extend in a common plane.

Furthermore, an individual longitudinal side bar of the first set of longitudinal side bars 202 may be coaxial with an individual side bar of the second set of longitudinal side bars 204. As such, an individual longitudinal side bar of the first set of longitudinal side bars 202 may be secured to an individual side bar of the second set of longitudinal side bars 204 at a fitting, which may be, for example, a tee fitting 222.

An individual longitudinal side bar of the first set of longitudinal side bars 202 may have a first longitudinal length L1, and an individual side bar of the second set of longitudinal side bars 204 may have a second longitudinal length L2, as shown in FIG. 25. In one approach, the first longitudinal length L1 is equal, or substantially equal, to the second longitudinal length L2. As used herein, a longitudinal length of an individual side bar may encompass a fitting secured at an end of the individual side bar. In still another aspect, the longitudinal length of an individual side bar may not encompass a fitting secured at an end of the individual side bar. A shared longitudinal length may be in the range, for example, of approximately 8 inches to approximately 15 inches, and more particularly, approximately 10 inches. Other shared longitudinal lengths (e.g., less than approximately 8 inches or greater than approximately 15 inches) are expressly contemplated.

The support base 200 further includes a middle support 230 disposed at the central region 210. In one approach, the middle support 230 includes generally upright support arms 232 that extend upwardly and from the longitudinal side bars 202, 204. In one aspect, the support arms 232 extend from the tee fitting 222. In another aspect, the support arms 232 are integrally formed with one or more of the longitudinal side bars 202, 204.

The support arms 232 may extend inwardly and generally toward each other. For example, the support arms 232 may form an angle θ therebetween, as depicted in FIG. 24. In one approach, the angle θ is an acute angle. The angle may be in the range, for example, of approximately 15 degrees to approximately 65 degrees. In one approach, the angle is approximately 40 degrees.

The middle support 230 may further include a central support bar 234 that extends between the support arms 232. The central support bar 234 may generally extend in a plane that is parallel to the plane of the longitudinal side bars 202, 204. In still another approach, the support arms 232 intersect such that the middle support 230 does not include a central support bar 234.

The support base 200 further includes a first lip 242 and a second lip 244. The first lip 242 may extend between an individual longitudinal side bar of the first set of longitudinal side bars 202 and an individual side bar of the second set of longitudinal side bars 204 at the first end portion 212. The second lip 244 may extend between an individual longitudinal side bar of the first set of longitudinal side bars 202 and an individual side bar of the second set of longitudinal side bars 204 at the second end portion 214. The first and second lips 242, 244 may be secured to individual side bars of the first and second set of longitudinal side bars 202, 204 at fittings, which may be, for example, elbow fittings 224. In still another approach, the first and second lips 242, 244 are integrally formed with side bars of the first and second set of longitudinal side bars 202, 204

At least one of the first lip 242 and the second lip 244 may be upstanding or raised lips that extend away from the plane formed by the longitudinal side bars 202, 204. In the approach shown, both the first lip 242 and the second lip 244 are raised lips that include a central curved portion.

In the assembled configuration of the training aid assembly, the support base 200 supports a training pad 14 in a generally upright position. More particularly, the training pad 14 is positioned such that a mid-portion of the training pad 14 engages the middle support 230 of the support base 200. In a first arrangement, the first lip 242 and the middle support 230 cooperate to maintain the training pad 14 (shown in solid line) in the generally upright position. In this position, an upper portion of the training pad 14 may be angled away from the first end portion 212 of the support base 200 and toward the second end portion 214. In a second arrangement, the second lip 244 and the middle support 230 cooperate to maintain the training pad 14 (shown in dashed line) in the generally upright position. In this position, an upper portion of the training pad 14 may be angled away from the second end portion 214 of the support base 200 and toward the first end portion 212.

As such, the support base 200 depicted and described with respect to FIGS. 24-26 may be oriented in either direction to support the training pad 14 in the generally upright position. When one lip (e.g., first lip 242) is used to support the training pad 14 in the generally upright position, the other lip (e.g., second lip 244) provides opposing support for support base 200.

In use, a person may impact the training pad 14 to dislodge the training pad 14 from the support base 200. For example, a training athlete 16 may tackle or otherwise hit the training pad 14, with the training pad 14 simulating an opposing player. The arrangement of the first and second lips 242, 244 and the middle support 230 is such that the impact quickly dislodges the training pad 14 from the support base 200.

Referring to FIGS. 27-31, another support base 300 is shown. The support base 300 may be used in place of support base 12 in the training aid assembly 10 of FIGS. 1-16. The support base 300 includes opposing longitudinal support or base members, which may be in the form of longitudinal side bars, that extend between opposing end regions. More particularly, a first set of longitudinal side bars 302 may extend between a central region 310 of the support base 300 and a first end portion 312 of the support base 300, and a second set of longitudinal side bars 304 may extend between the central region 310 and a second end portion 314 of the support base 300. The first set of longitudinal side bars 302 and the second set of longitudinal side bars 304 may extend in a common plane. One or more bars of the first set of longitudinal side bars 302 and/or the second set of longitudinal side bars 304 may be hollow tubular portions.

Furthermore, an individual longitudinal side bar of the first set of longitudinal side bars 302 may be coaxial with an individual side bar of the second set of longitudinal side bars 304. As such, an individual longitudinal side bar of the first set of longitudinal side bars 302 may be secured to an individual side bar of the second set of longitudinal side bars 304 at a fitting, which may be, for example, a tee fitting 322.

Figure 28:
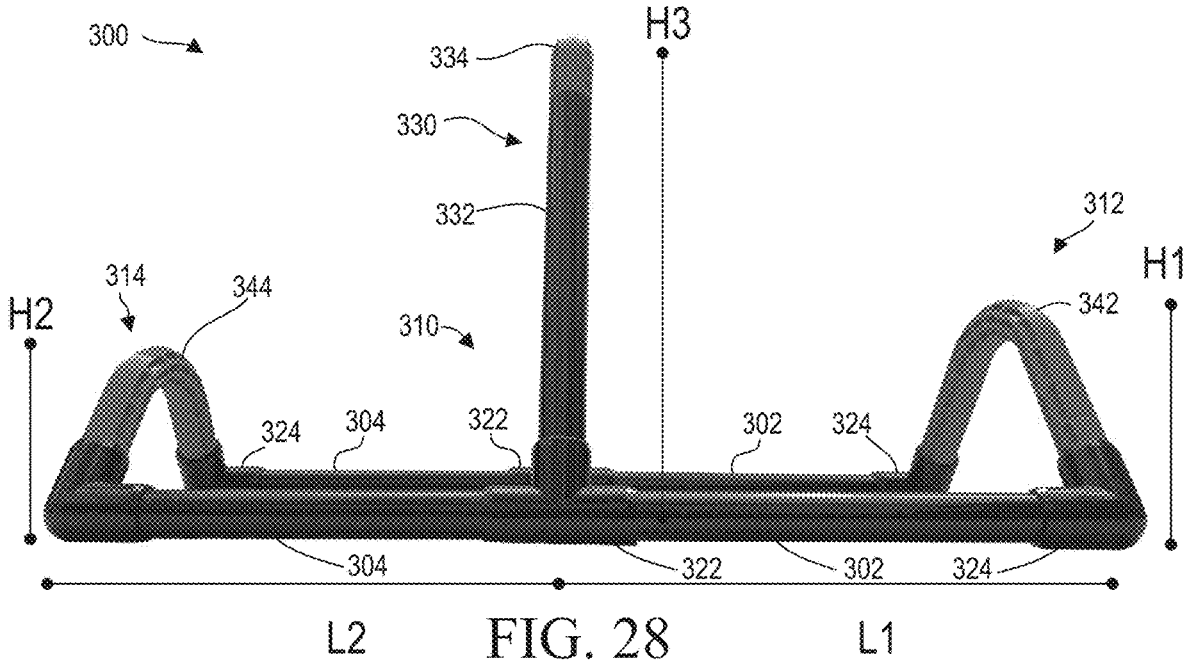
FIG. 28 is a left side elevation view of the support base of FIG. 27, the right side elevation view being a mirror image of the left side elevation view.
Figure 29:
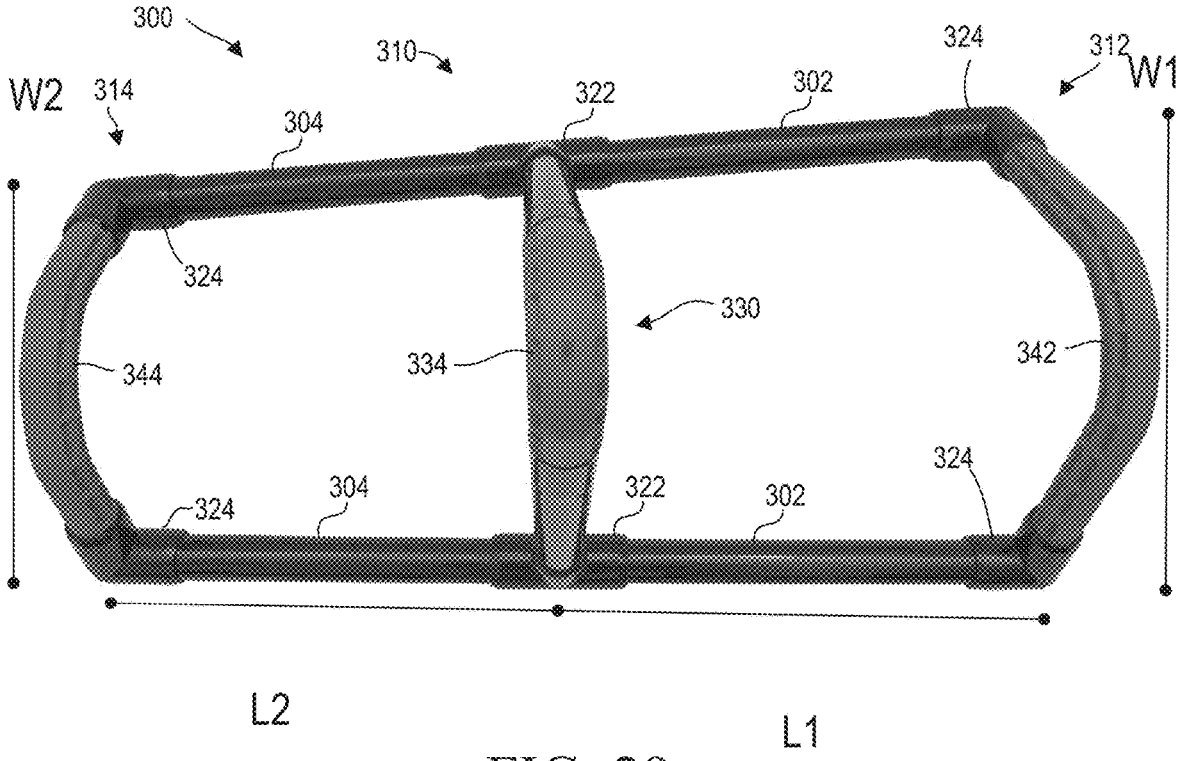
FIG. 29 is a top plan view of the support base of FIG. 27.

An individual longitudinal side bar of the first set of longitudinal side bars 302 may have a first longitudinal length L1, and an individual side bar of the second set of longitudinal side bars 304 may have a second longitudinal length L2, as shown in FIGS. 28 and 29. In one approach, the first longitudinal length L1 is greater than the second longitudinal length L2. As used herein, a longitudinal length of an individual side bar may encompass a fitting secured at an end of the individual side bar. In still another aspect, the longitudinal length of an individual side bar may not encompass a fitting secured at an end of the individual side bar. In one example approach, the first longitudinal length L1 may be approximately 10 inches, and the second longitudinal length L2 may be approximately 9 inches.

The support base 300 further includes a middle support 330 disposed at the central region 310. In one approach, the middle support 330 generally forms and inverted "V." For example, the middle support 330 may include generally upright support arms 332 that extend upwardly and inwardly from the longitudinal side bars 302, 304. In one aspect, the support arms 332 extend from the tee fitting 322. In another aspect, the support arms 332 are integrally formed with one or more of the longitudinal side bars 302, 304.

Figure 27:
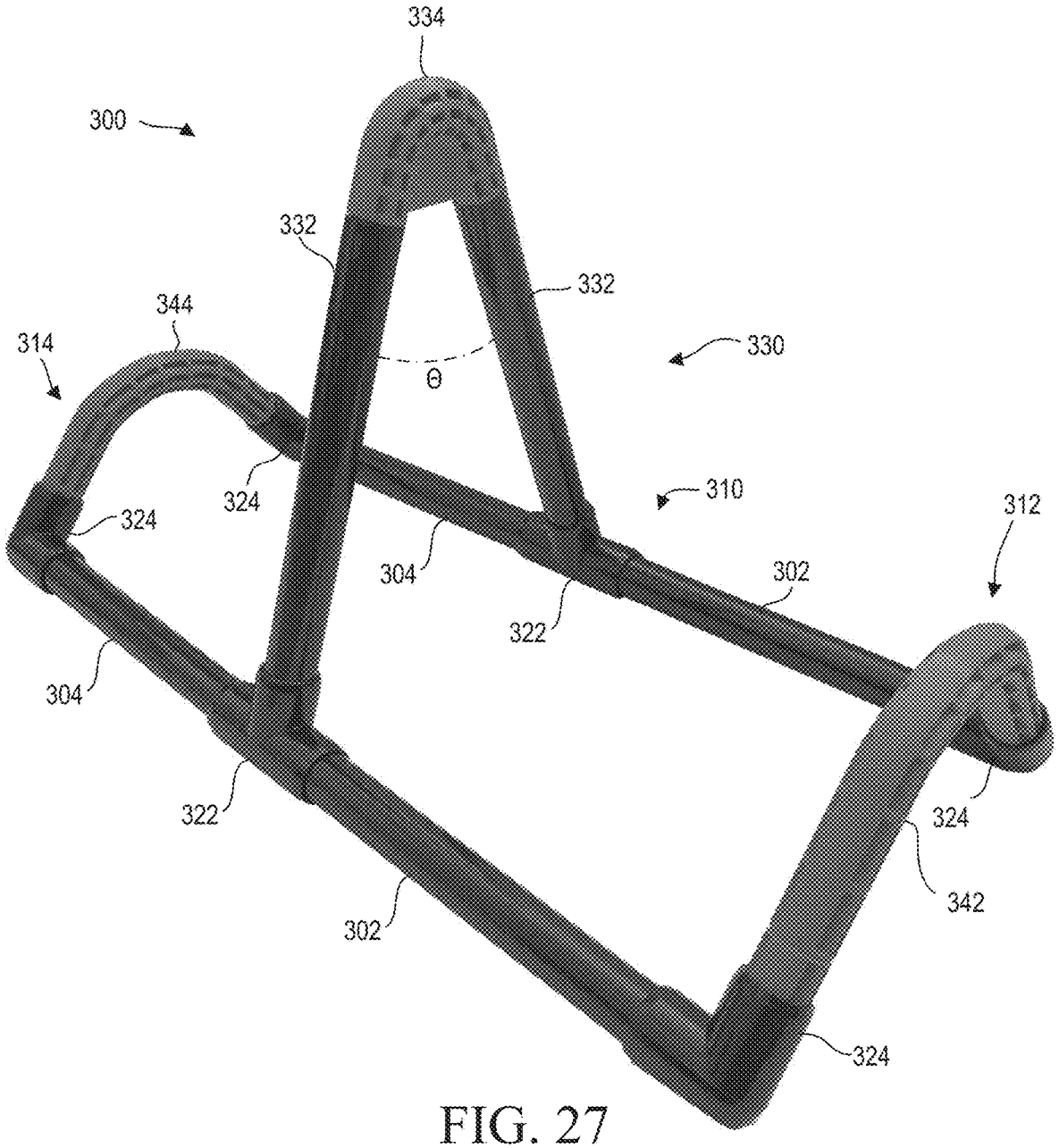
FIG. 27 is a perspective view of a fifth embodiment of a support base for the training aid assembly of FIG. 1.

The support arms 332 may extend inwardly and generally toward each other. For example, the support arms 332 may form an angle θ therebetween, as depicted in FIG. 27. In one approach, the angle θ is an acute angle. The angle may be in the range, for example, of approximately 15 degrees to approximately 65 degrees. In one approach, the angle is approximately 40 degrees.

The middle support 330 may further include a central support portion 334 that extends between the support arms 332. The central support portion 334 may generally extend in a plane that is parallel to the plane of the longitudinal side bars 302, 304. In still another approach, the support arms 332 intersect such that the middle support 330 does not include a central support portion 334.

The support base 300 further includes a first lip 342 and a second lip 344. The first lip 342 may extend between an individual longitudinal side bar of the first set of longitudinal side bars 302 and an individual side bar of the second set of longitudinal side bars 304 at the first end portion 312. The second lip 344 may extend between an individual longitudinal side bar of the first set of longitudinal side bars 302 and an individual side bar of the second set of longitudinal side bars 304 at the second end portion 314. The first and second lips 342, 344 may be secured to individual side bars of the first and second set of longitudinal side bars 302, 304 at fittings, which may be, for example, elbow fittings 324. In still another approach, the first and second lips 342, 344 are integrally formed with side bars of the first and second set of longitudinal side bars 302, 304

At least one of the first lip 342 and the second lip 344 may be raised lips that extend away from the plane formed by the longitudinal side bars 302, 304. In the approach shown, both the first lip 342 and the second lip 344 are raised lips that include a central generally arcuate lip portions that extend between the opposing longitudinal side bars 302, 304. In one approach, the central generally arcuate lip portions have a common radius of curvature. One or both of the first lip 342 and the second lip 344 may include opposing straight portions 342A, 344A that extend from the central generally arcuate lip portions. The first lip 342 and the second lip 344 may extend upwardly in planes that are generally parallel to each other. Furthermore, the middle support 330 may extend generally parallel to one or both of the first lip 342 and the second lip 344.

The first lip 342 and the second lip 344 may have different dimensions. For example, the opposing straight portions 344A of the second lip 344 may be longer than the opposing straight portions 342A of the first lip 342. In this way, the first lip 342 may have a first total length, and the second lip 344 may have a second total length that is different than the first length. In one example, the first lip 342 may have a total length of approximately 12 inches, and the second lip 344 may have a total length of approximately 9 inches.

In this way, as shown in FIG. 28, the support base 300 may have a first height H1 at the first end portion 312, and a second height H2 at the second end portion 314 that is different (e.g., less than) than the first height H1. The support base may have a third height at the middle support 330 that is greater than each of the first height H1 and the second height H2.

Figure 30:
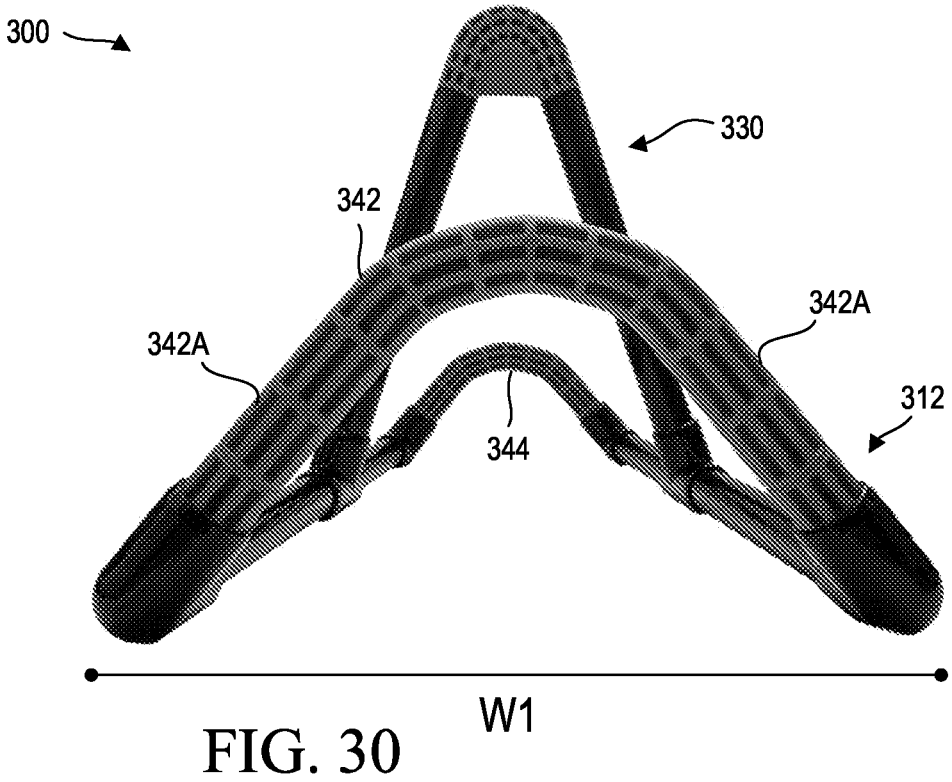
FIG. 30 is a first elevation view of the support base of FIG. 27.
Figure 31:
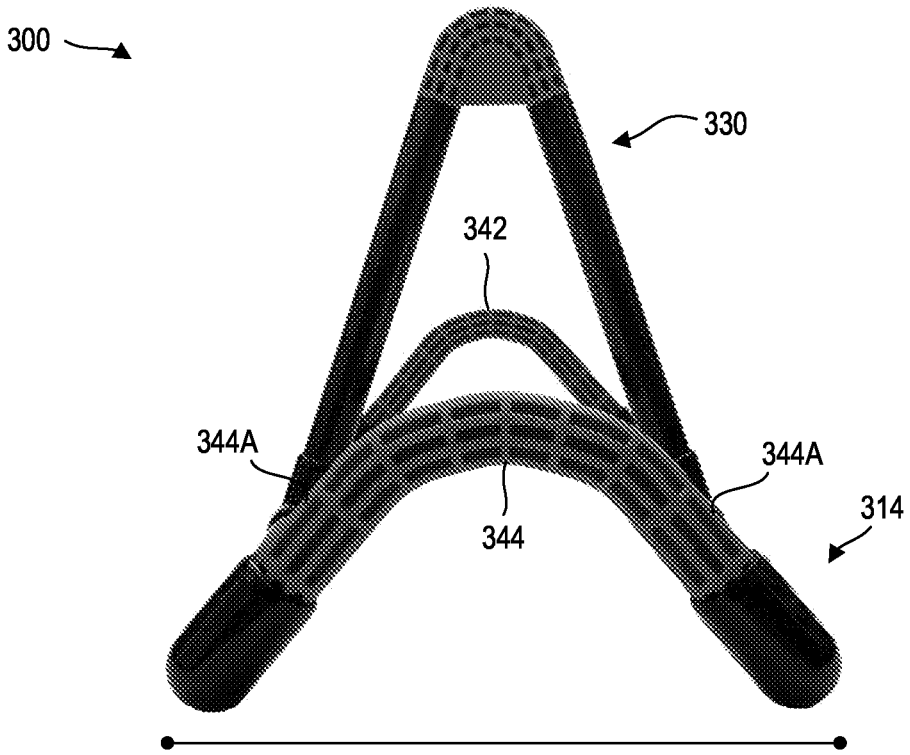
FIG. 31 is a second, opposite elevation view of the support base of FIG. 27.

Furthermore, as shown in FIGS. 29-31, the support base 300 may have a first width W1 at the first end portion 312, and a second width W2 at the second end portion 314 that is different (e.g., less than) than the first height H1.

Figure 32:
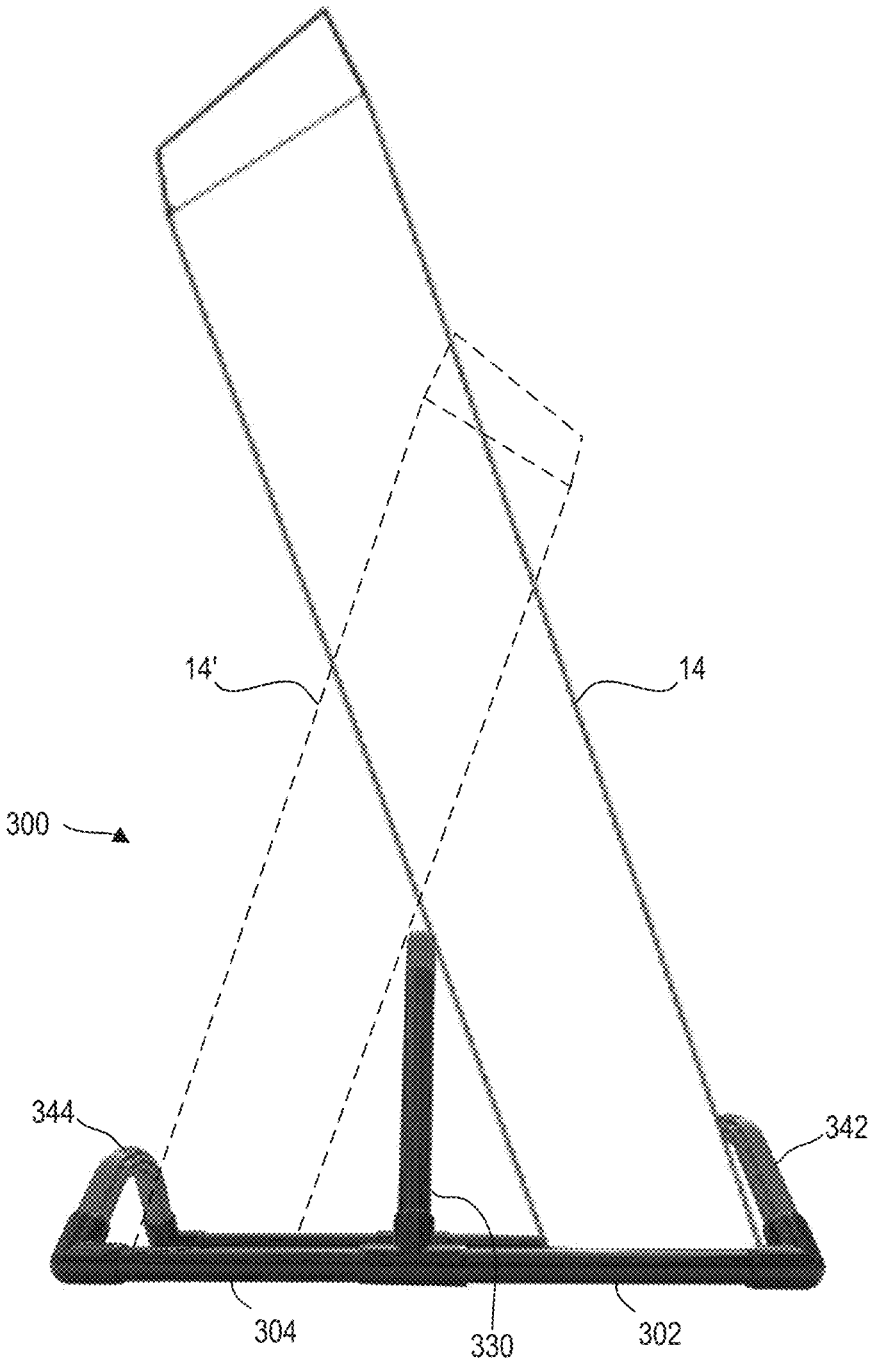
FIG. 32 is a side perspective view of the training aid assembly including a training aid disposed on the support base of FIG. 27.

Referring to FIG. 32, in the assembled configuration of the training aid assembly, the support base 300 supports a training pad 14 in a generally upright position. More particularly, the training pad 14 is positioned such that a mid-portion of the training pad 14 engages the middle support 330 of the support base 300. In a first arrangement, the first lip 342 and the middle support 330 cooperate to maintain the training pad 14 (shown in solid line) in the generally upright position. In this position, an upper portion of the training pad 14 may be angled away from the first end portion 312 of the support base 300 and toward the second end portion 314. In a second arrangement, the second lip 344 and the middle support 330 cooperate to maintain a training pad 14' (shown in dashed line) in a generally upright position. In this position, an upper portion of the training pad 14' may be angled away from the second end portion 314 of the support base 300 and toward the first end portion 312.

The training pad 14' may have a different dimension than training pad 14. For example, the training pad 14' may be smaller than training pad 14. In at least one approach, training pad 14 may have a height of approximately 7 to 8, a width of approximately 18 inches, and a length of approximately 50 inches. Training pad 14' may have a height of approximately 6 inches, a width of approximately 12 inches, and a length of approximately 41 inches. As such, training pad 14' may be considered a "youth" training pad. In still another approach, training pad 14' may have a height of approximately 11 to 12 inches, a width of approximately 18 inches, and a length of approximately 50 inches. As such, the support base 300 depicted and described with respect to FIGS. 27-32 may be configured to receive training pads (e.g., training pad 14 or training pad 14') of various sizes.

Figure 33:
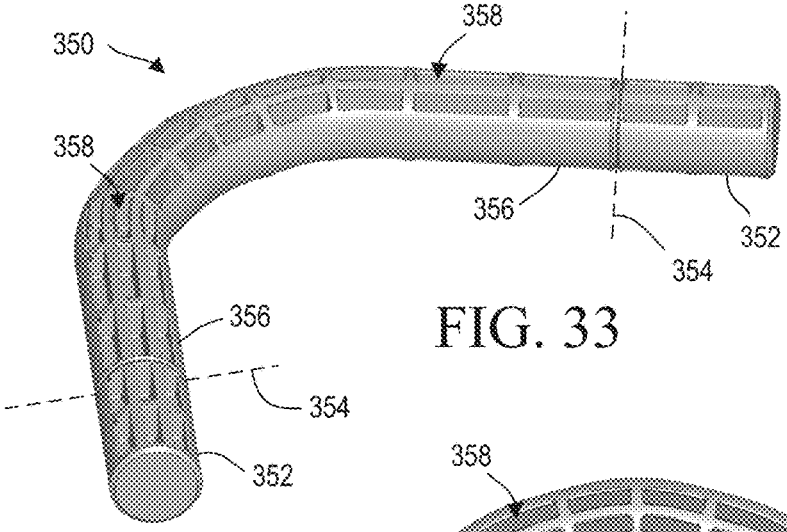
FIG. 33 is a perspective view of a lip of the support base of FIG. 27.
Figure 34:
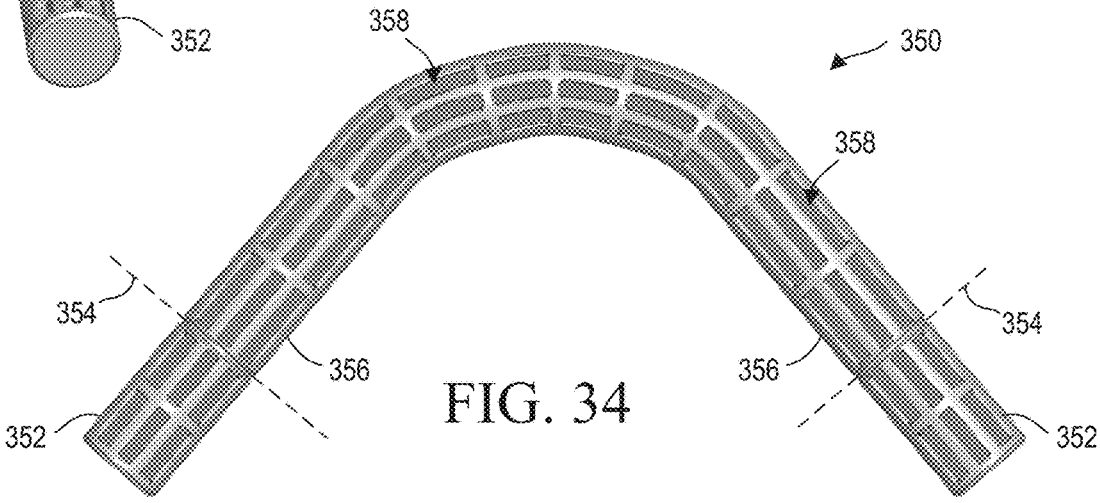
FIG. 34 is a top plan view of the lip of FIG. 33.

Referring to FIGS. 33 and 34, the first and second lips 342, 344 may be formed by a lip insert 350. The lip insert 350 may have first lip ends 352 that may be secured to elbow fittings 324 at the first end portion 312 of the support base 300 to form the first lip 342. The lip insert 350 may further include break points 354 inward of the first lip ends 352 (e.g., approximately 1 inch inward of the first lip ends 352). Upon removal of the first lip ends 352 (e.g., due to cutting the lip insert 350 at the break points 354), the lip insert 350 forms second lip ends 356. The second lip ends 356 may be secured to elbow fittings 324 at the second end portion 314 of the support base 300 to form the second lip 344. In one approach, the lip insert 350 may include a plurality of recesses 358 formed in the outer surface of the lip insert 350. The plurality of recesses 358 may be formed in an array in side surfaces of the lip insert 350. Optionally, the recesses 358 may be formed in upper and/or lower surfaces of the lip insert 350. The recesses 358 may reduce the weight of the first and second lips 342, 344, may reduce material costs during manufacture of the support base 300, and may provide gripping surfaces when transporting the support base 300 by the first or second lip 342, 344.

Figure 35:
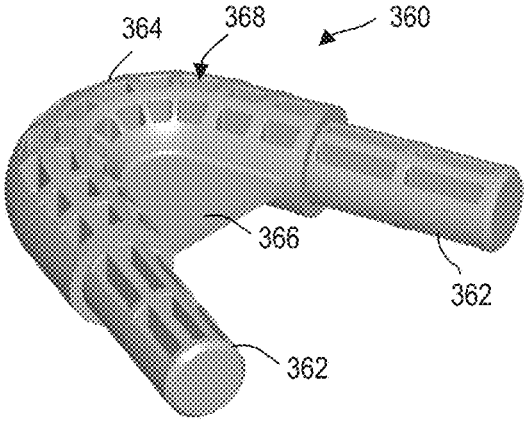
FIG. 35 is a perspective view of a central support portion of the support base of FIG. 27.
Figure 36:
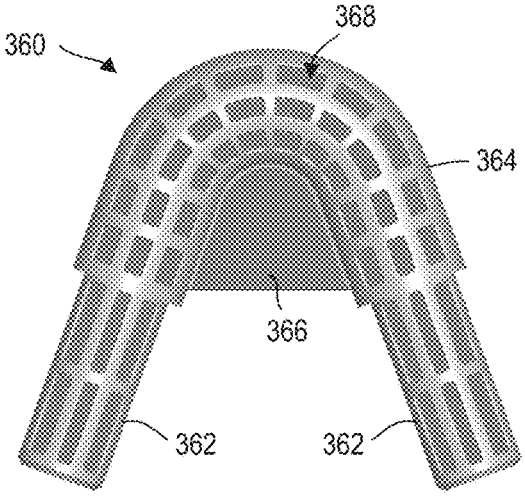
FIG. 36 is a top plan view of the central support portion of FIG. 33.

Referring to FIGS. 35 and 36, the central support portion 334 may be formed by a central insert 360. The central insert 360 may include two insert ends 362 that extend from a body portion 364 of the central insert 360. The insert ends 362 may be secured to the support arms 332 of the middle support 330 to form the central support portion 334. In one approach, the central insert 360 may include a webbing 366 that extends between arm portions of the body portion 364. The webbing 366 may increase the structural rigidity of the central insert 360. Similar to the lip insert 350, the central insert 360 may include a plurality of recesses 368 formed in the outer surface of the central insert 360.

It is expressly contemplated that various sizes and configurations of support bases may be provided. As such, different embodiments may be utilized to support various sized training pads or other training aids.

As used herein, the terms "bar" or "bars" may refer to an elongate member, and may include solid members (e.g., cylindrical elongate members) and/or hollow members (e.g., tubular elongate members). One or more of the elongate members may be straight elongate members (e.g., having no radius of curvature) or curved, arced, or angled elongate members (e.g., having a radius of curvature. The bars discussed herein may be discretely formed bars that may be connected (e.g., removably connected) via fittings, fasteners, mechanical bonds, chemical bonds, etc. In some approaches, one or more of the bars discussed herein may be integrally formed (e.g., injection molding, extrusion, etc.).

One or more portions of the support bases may be formed, for example, of any one or combination of plastic, rubber, elastomers, fiberglass, nylon, wood, corrugated paper, carbon fiber, polyvinyl chloride (PVC), polyethylene, acrylonitrile butadiene styrene (ABS), acetal, acrylic, ethylene vinyl acetate, polybutylene, polycarbonate, polyester, polyetherimide, polyethylene, polyphenylene oxide (PPO)/styrene copolymer (NORYL), polypropylene, polystyrene, polysulphone, polyurethane, styrene acrylonitrile, glass-fiber composites, silicone material metals (e.g., aluminum or steel), etc.

While exemplary embodiments are described above, it is not intended that these embodiments describe all possible forms encompassed by the claims. The words used in the specification are words of description rather than limitation, and it is understood that various changes may be made without departing from the spirit and scope of the disclosure. As previously described, the features of various embodiments may be combined to form further embodiments of the invention that may not be explicitly described or illustrated. While various embodiments could have been described as providing advantages or being preferred over other embodiments or prior art implementations with respect to one or more desired characteristics, those of ordinary skill in the art recognize that one or more features or characteristics may be compromised to achieve desired overall system attributes, which depend on the specific application and implementation. These attributes may include, but are not limited to cost, strength, durability, life cycle cost, marketability, appearance, packaging, size, serviceability, weight, manufacturability, ease of assembly, etc. As such, embodiments described as less desirable than other embodiments or prior art implementations with respect to one or more characteristics are not outside the scope of the disclosure and may be desirable for particular applications.

The invention claimed is:

1. A support base for a training aid assembly, the support base comprising:

opposing longitudinal base members;

a first lip extending between the opposing longitudinal base members at a distal portion of the support base;

a second lip extending between the opposing longitudinal base members at a proximal portion of the support base; and an intermediate support member extending between the opposing longitudinal base members at an intermediate portion of the support base between the distal portion and the proximal portion, wherein the first lip extends to a first height from the longitudinal base members, and wherein the second lip extends to a second height from the longitudinal base members, wherein the intermediate support member forms a generally inverted V that includes a central support portion and support arms that extend between the central support portion and the longitudinal base members.

2. The training aid assembly of claim 1 wherein the second lip extends to a second height from the longitudinal base members that is different than the first height, and wherein the intermediate support member extends to a third height from the longitudinal base members that is greater than the first height and the second height.

3. The training aid assembly of claim 1 wherein intermediate support member is disposed along the opposing longitudinal base members closer to one of the first lip or the second lip than to the other of the first lip and the second lip.

4. The training aid assembly of claim 1 wherein the first lip and the second lip include central generally arcuate lip portions that extend between the opposing longitudinal base members.

5. The training aid assembly of claim 4 wherein the central generally arcuate lip portions have same radius values.

6. The training aid assembly of claim 4 wherein the first lip and the second lip include opposing straight portions that extend from the central generally arcuate lip portions.

7. The training aid assembly of claim 6 wherein the opposing straight portions of the second lip are longer than the opposing straight portions of the first lip.

8. The training aid assembly of claim 1 wherein first lip and the second lip form right angle junctions with end portions of the longitudinal base members.

9. The training aid assembly of claim 1 wherein the support base forms a first width at the distal portion and a second width that is different than the first width at the proximal portion.

10. A training aid assembly comprising:

a training pad; and a support base for supporting the training pad, the support base including opposing longitudinal support bars, a first raised lip extending between the opposing longitudinal support bars at a distal portion of the support base, a second raised lip extending between the opposing longitudinal support bars at a proximal portion of the support base, and an intermediate raised member extending between the opposing longitudinal support bars at an intermediate portion of the support base between the distal portion and the proximal portion, wherein in an assembled configuration, the training pad engages the intermediate raised member and at least one of the first raised lip and the second raised lip, wherein the support base forms a first width at the distal portion and a second width that is different than the first width at the proximal portion.

11. The training aid assembly of claim 10 wherein the training pad is an elongated training pad, and wherein in the assembled configuration, the support base supports the elongated training pad in a generally upright position of the elongated training pad.

12. The training aid assembly of claim 11 wherein the generally upright position is in the range of approximately 0 degrees to less than approximately 45 degrees off vertical.

13. The training aid assembly of claim 10 wherein the training pad is a generally ring-shaped training pad, and wherein in the assembled configuration, the support base supports the generally ring-shaped training pad in a generally upright position of the generally ring-shaped training pad.

14. The training aid assembly of claim 10 wherein in the assembled configuration, a first planar surface of the training pad engages the at least one of the first raised lip and the second raised lip at an end portion of the training pad, and a second planar surface of the training pad opposite the first planar surface engages the intermediate raised member at an intermediate portion of the training pad.

15. The training aid assembly of claim 10 wherein the training pad is a first training pad having a first height when in the assembled configuration, and wherein the training aid assembly further includes a second training pad having a second height different than the first height when in the assembled configuration.

16. The training aid assembly of claim 10, wherein the intermediate raised member forms a generally inverted V that includes a central support portion and support arms that extend between the central support portion and the longitudinal support bars.

17. A method for using a training aid assembly, comprising:

providing a support base that includes a proximal raised member at a proximal portion of the support base, and an intermediate raised member at an intermediate portion of the support base, the intermediate raised member extending to a height greater than the proximal raised member;

assembling a training pad with the support base such that in an assembled configuration, the training pad engages the proximal raised member and the intermediate raised member, and the training pad is supported in a generally upright positions;

arranging the training aid assembly on a playing surface; and simulating a football action including impacting the training pad such that the training pad disengages from the support base.

18. The method of claim 17, wherein the support base includes a distal raised member disposed opposite the intermediate raised member from the proximal raised member, the method further comprising:

assembling the training pad with the support base such that in a second assembled configuration, the training pad engages the distal raised member and the intermediate raised member, and the training pad is supported in a generally upright position.

19. The method of claim 17, further comprising:

providing a plurality of training aid assemblies; and stacking individual training aid assemblies of the plurality of training aid assemblies together to form a vertical stack of training aid assemblies.

20. The method of claim 17, wherein the intermediate raised member forms a generally inverted V that includes a central support portion and support arms.

* * * * *